US010967657B2

(12) United States Patent
Takada

(10) Patent No.: US 10,967,657 B2
(45) Date of Patent: Apr. 6, 2021

(54) MEDIUM TRANSPORTING DEVICE AND LIQUID JETTING DEVICE

(71) Applicant: FUJIFILM Corporation, Tokyo (JP)

(72) Inventor: Kensuke Takada, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 16/447,944

(22) Filed: Jun. 20, 2019

(65) Prior Publication Data

US 2019/0308427 A1 Oct. 10, 2019

Related U.S. Application Data

(63) Continuation of application No. PCT/JP2018/002705, filed on Jan. 29, 2018.

(30) Foreign Application Priority Data

Feb. 15, 2017 (JP) ..... JP2017-026020

(51) Int. Cl.
*B41J 2/01* (2006.01)
*B41J 13/22* (2006.01)
(Continued)

(52) U.S. Cl.
CPC ..... *B41J 13/226* (2013.01); *B41F 21/104* (2013.01); *B41J 2/01* (2013.01); *B41J 13/22* (2013.01);
(Continued)

(58) Field of Classification Search
None
See application file for complete search history.

(56) References Cited

U.S. PATENT DOCUMENTS

2004/0244864 A1 12/2004 Forche
2011/0025807 A1 2/2011 Fukui
(Continued)

FOREIGN PATENT DOCUMENTS

JP H01106230 7/1989
JP 2004359465 12/2004
(Continued)

OTHER PUBLICATIONS

"International Search Report (Form PCT/ISA/210) of PCT/JP2018/002705," dated Apr. 24, 2018, with English translation thereof, pp. 1-5.
(Continued)

*Primary Examiner* — Erica S Lin
*Assistant Examiner* — Tracey M McMillion
(74) *Attorney, Agent, or Firm* — JCIPRNET

(57) ABSTRACT

A medium transporting device and a liquid jetting device, which can suppress the lifting of both ends of a medium in a width direction of a medium and can suppress the occurrence of wrinkling of the medium, are provided. The medium transporting device includes a gripping unit that grips a leading end region of a medium, a medium supporting unit that has a first adsorption supporting unit which adsorbs and supports a trailing end region of the medium and a second adsorption supporting unit which adsorbs a non-end region of the medium and generates an adsorption pressure less than an adsorption pressure generated by the first adsorption supporting unit, a medium position moving unit that moves a position in a medium width direction in the medium width direction, and a medium transporting unit that transports the medium. Regarding the width direction, the first adsorption supporting unit has a length, which is obtained by adding a length twice a moving distance of the medium to a medium length, and a distance from a center
(Continued)

position in the width direction to one end in the width direction is the same as a distance from the center position in the width direction to the other end in the width direction.

16 Claims, 17 Drawing Sheets

(51) Int. Cl.
*B41F 21/10* (2006.01)
*B65H 5/12* (2006.01)
*B65H 5/22* (2006.01)

(52) U.S. Cl.
CPC ..... *B65H 5/12* (2013.01); *B65H 5/22* (2013.01); *B65H 2405/57* (2013.01)

(56) References Cited

U.S. PATENT DOCUMENTS

2012/0169006 A1* 7/2012 Matsuda ..... B65H 9/06 271/3.19
2013/0050376 A1* 2/2013 Houjou ..... B41J 11/002 347/104
2015/0138294 A1 5/2015 Ozaki

FOREIGN PATENT DOCUMENTS

| | | |
|---|---|---|
| JP | 2007144848 | 6/2007 |
| JP | 2011032036 | 2/2011 |
| JP | 2011032037 | 2/2011 |
| JP | 2011126660 | 6/2011 |
| JP | 2014024198 | 2/2014 |
| JP | 2016132540 | 7/2016 |

OTHER PUBLICATIONS

"Written Opinion of the International Searching Authority (Form PCT/ISA/237) of PCT/JP2018/002705," dated Apr. 24, 2018, with English translation thereof, pp. 1-7.

* cited by examiner

MEDIUM TRANSPORTING DEVICE AND LIQUID JETTING DEVICE

CROSS-REFERENCE TO RELATED APPLICATIONS

The present application is a Continuation of PCT International Application No. PCT/JP2018/002705 filed on Jan. 29, 2018 claiming priority under 35 U.S.C § 119(a) to Japanese Patent Application No. 2017-026020 filed on Feb. 15, 2017. Each of the above applications is hereby expressly incorporated by reference, in their entirety, into the present application.

BACKGROUND OF THE INVENTION

1. Field of the Invention

The present invention relates to a medium transporting device and a liquid jetting device, and relates particularly to supporting of a medium in transporting of the medium.

2. Description of the Related Art

For a medium transporting device that transports a medium with the use of a transport drum, a technique of transporting the medium with the use of a gripper gripping a leading end is known. In a case where a plurality of types of media having different sizes from each other are used, a free state where both ends of the medium in a width direction of a medium are not gripped by the gripper may be caused in the transport drum, in which a position of the gripper in the width direction of a medium orthogonal to a transporting direction of a medium is fixed.

In a free state where both ends of the medium in the width direction of a medium are not gripped by the gripper, the lifting of both ends of the medium in the width direction of a medium is likely to occur. In particular, in a liquid jetting device comprising an ink jet liquid jetting head, the lifting of a medium in a jetting region of the liquid jetting head can be a cause of contact between the liquid jetting head and the medium.

In a case where the lifting of the medium in the jetting region of the liquid jetting head occurs, transporting of the medium is stopped before the medium enters the jetting region of the liquid jetting head, thereby avoiding contact between the liquid jetting head and the medium and protecting the liquid jetting head. However, due to the stop of the transporting of the medium, there is a possibility of a productivity decrease.

Even a medium transporting device that transports a medium along any plane, including a horizontal plane, with the use of a transporting member including a transporting belt has the problem as in a printing device that transports a medium with the use of the transport drum.

A liquid jetting device that transports a medium with the use of a transport drum is disclosed in JP2011-032037A. The liquid jetting device disclosed in JP2011-032037A comprises a gripper in the transport drum, and transports the medium along an outer circumferential surface of the transport drum with a leading end region of the medium being gripped by the gripper.

A transport drum in the present specification corresponds to a drawing drum in JP2011-032037A. A medium in the present specification corresponds to a recording medium in JP2011-032037A. A liquid jetting device in the present specification corresponds to an ink jet recording device in JP2011-032037A.

A liquid jetting device that transports a medium with the use of a transport drum is disclosed in JP2004-359465A. The transport drum disclosed in JP2004-359465A comprises a gripper that grips a leading end region of the medium. The transport drum disclosed in JP2004-359465A moves a center position of the medium in the width direction of a medium, and moves positions of both ends of the medium in the width direction of a medium to a position of the gripper.

The transport drum in the present specification corresponds to a flat paper transporting cylinder in JP2004-359465A. The medium in the present specification corresponds to printing flat paper in JP2004-359465A. The liquid jetting device in the present specification corresponds to a flat paper transporting device in JP2004-359465A. A gripper in the present specification corresponds to a gripper in JP2004-359465A.

SUMMARY OF THE INVENTION

A position of the gripper in the width direction of a medium is fixed in the invention disclosed in JP2011-032037A. For this reason, in a case where a center position in the width direction of a medium is fixed, positions of both ends in the width direction of a medium do not match the position of the gripper. In a case where a free state where both ends in the width direction of a medium are not gripped by the gripper is caused, it is difficult to suppress the lifting of both ends in the width direction of a medium.

In the invention disclosed in JP2004-359465A, the center position in the width direction of a medium is moved, and thus the positions of both ends in the width direction of a medium match the position of the gripper. However, in a case where the medium is adsorbed and supported, variation in an adsorption pressure can occur on both sides of the center position in the width direction of a medium due to the movement of the center position in the width direction of a medium.

The variation in an adsorption pressure on both sides of the center position in the width direction of a medium can be a cause of the occurrence of wrinkling of the medium.

The present invention is devised in view of such circumstances, and an object thereof is to provide a medium transporting device and a liquid jetting device, which can suppress the lifting of both ends of a medium in a width direction of a medium and can suppress the occurrence of wrinkling of the medium.

In order to achieve the object, the following aspects of the invention are provided.

According to a first aspect, there is provided a medium transporting device comprising a gripping unit that comprises a plurality of gripping members which grip a leading end region of a medium in a medium transporting direction, a medium supporting unit that comprises a first adsorption supporting unit which adsorbs and supports a trailing end region of the medium having a length determined in advance in the medium transporting direction from the trailing end of the medium in the medium transporting direction and a second adsorption supporting unit which adsorbs and supports a non-end region, which is a region other than the leading end region and the trailing end region of the medium, the second adsorption supporting unit generating an adsorption pressure less than an adsorption pressure generated by the first adsorption supporting unit, a medium position moving unit that moves a position of the medium in a width direction, which is a direction orthogonal to the medium transporting direction, the medium being supplied to the medium supporting unit, in the width direction, and a medium transporting unit that transports the medium supported by the medium supporting unit in the medium transporting direction. Regarding the width direction, the first adsorption supporting unit has a length in the width direction, which is obtained by adding a length twice a moving distance of the medium by the medium position moving unit to a medium length of a size allowing the first adsorption supporting unit to adsorb and support the trailing end region, and a distance from a center position in the width direction to one end in the width direction is the same as a distance from the center position in the width direction to the other end in the width direction.

According to the first aspect, both ends of the medium in the width direction of a medium are supported. In addition, an adsorption pressure to be applied to the medium is uniformized from the center position in the width direction of a medium to both sides in the width direction of a medium, and the occurrence of wrinkling of the medium is suppressed.

The leading end region of the medium is a region having the length determined in advance from the leading end of the medium in a direction opposite to the medium transporting direction. The leading end of the medium is at a position of the medium on the most downstream side in the medium transporting direction. In addition, the trailing end region of the medium is a region having the length determined in advance from the trailing end of the medium in the medium transporting direction. The trailing end of the medium is at a position of the medium on the most upstream side in the medium transporting direction.

According to a second aspect, in the medium transporting device of the first aspect, regarding the width direction, the first adsorption supporting unit may be configured to have a length, which is obtained by adding a length twice a moving distance of a medium by the medium position moving unit to a medium length of a maximum size allowing the first adsorption supporting unit to adsorb and support the trailing end region, and a distance from a center position in the width direction to one end in the width direction may be configured to be the same as a distance from the center position in the width direction to the other end in the width direction.

According to the second aspect, it is possible to obtain the same operational effects as the first aspect with the medium having the maximum size allowing the first adsorption supporting unit to adsorb and support the trailing end region.

According to a third aspect, in the medium transporting device of the first aspect or the second aspect, positions of both ends of the first adsorption supporting unit in the width direction may be configured to be disposed at positions of any of the plurality of gripping members in the width direction.

According to the third aspect, it is possible for the first adsorption supporting unit to adsorb and support the trailing end region of the medium, which is moved in the width direction and of which an end in the width direction of a medium is gripped by the gripping unit.

According to a fourth aspect, in the medium transporting device of any one aspect of the first aspect to the third aspect, the medium position moving unit may be configured to move the medium, of which the one end of the medium in the width direction is not gripped, to a position where the gripping unit grips the one end of the medium in the width direction in a case where the center position of the medium in the width direction is aligned with a transporting center, which is a center position of the medium supporting unit in the width direction.

According to the fourth aspect, it is possible to grip the one end in the width direction of a medium due to the movement in the width direction of a medium.

According to a fifth aspect, in the medium transporting device of any one aspect of the first aspect to the fourth aspect, the medium position moving unit may be configured to move the medium, of which the other end of the medium in the width direction is not gripped, to a position where the gripping unit grips the other end of the medium in the width direction in a case where the center position of the medium in the width direction is aligned with a transporting center, which is a center position of the medium supporting unit in the width direction.

According to the fifth aspect, it is possible to grip the other end in the width direction of a medium due to the movement in the width direction of a medium.

According to a sixth aspect, in the medium transporting device of any one aspect of the first aspect to the fifth aspect, the first adsorption supporting unit may be configured to have a length corresponding to a plurality of types of media having different lengths in the width direction from each other.

According to the sixth aspect, it is possible to adsorb the trailing end region of a medium, the medium being one of the plurality of types of media having different lengths in the width direction of a medium from each other.

According to a seventh aspect, in the medium transporting device of any one aspect of the first aspect to the sixth aspect, the medium supporting unit may be configured to comprise a plurality of the first adsorption supporting units, and the plurality of the first adsorption supporting units are configured to be arranged along the medium transporting direction.

According to the seventh aspect, it is possible to adsorb and support the trailing end region of a medium, the medium being one of the media having different lengths in the medium transporting direction from each other.

According to an eighth aspect, in the medium transporting device of any one aspect of the first aspect to the seventh aspect, the medium supporting unit may be configured to comprise a third adsorption supporting unit that adsorbs and supports the trailing end region, regarding the width direction, the third adsorption supporting unit having a length, which is equal to or smaller than a medium length of a size allowing the third adsorption supporting unit to adsorb and support the trailing end region.

According to the eighth aspect, it is possible to adsorb and support the trailing end region of the medium having the size, which allows the trailing end region to be adsorbed and supported, in the width direction of a medium.

According to a ninth aspect, in the medium transporting device of the eighth aspect, the third adsorption supporting unit may be configured to have a length which is equal to or smaller than a medium length of a maximum size allowing the third adsorption supporting unit to adsorb and support the trailing end region.

According to the ninth aspect, it is possible to adsorb and support the trailing end region of the medium having the maximum size, which allows the trailing end region to be adsorbed and supported, in the width direction of a medium.

According to a tenth aspect, in the medium transporting device of any one aspect of the first aspect to the ninth aspect, the first adsorption supporting unit may be configured to comprise a plurality of first adsorption holes. The second adsorption supporting unit may be configured to comprise a plurality of second adsorption holes. A total area of the plurality of first adsorption holes per unit area in the first adsorption supporting unit may be configured to exceed a total area of the plurality of second adsorption holes per unit area in the second adsorption supporting unit.

According to the tenth aspect, the trailing end region is strongly supported compared to the non-end region. Accordingly, the lifting of the trailing end region is suppressed.

According to an eleventh aspect, in the medium transporting device of any one aspect of the first aspect to the tenth aspect, the gripping member may be configured to comprise a gripping claw and a claw stand, and to have a structure of gripping the leading end region of the medium between the gripping claw and the claw stand. At least one of the gripping claws respectively included in the plurality of gripping members may be configured to be a wide claw having a length in the width direction, which is larger than the other gripping claws.

According to the eleventh aspect, the lifting of both ends of the medium in the width direction of a medium is suppressed.

According to a twelfth aspect, in the medium transporting device of the eleventh aspect, in the wide claw, a gripping region, which grips the medium between the claw stand and the wide claw, may be configured to have a projecting shape with respect to a non-gripping region, which does not grip the medium between the claw stand and the wide claw.

According to the twelfth aspect, medium damage due to the medium being sandwiched between a wide portion of the wide claw and the claw stand is suppressed.

According to a thirteenth aspect, in the medium transporting device of any one aspect of the first aspect to the twelfth aspect, the medium supporting unit may be configured to be a transport drum that has a cylindrical shape, and rotates about a center axis of the cylindrical shape as a rotation axis to transport the medium along an outer circumferential surface.

According to the thirteenth aspect, the lifting of the medium in the width direction of a medium is suppressed in transporting of the medium by the transport drum.

According to a fourteenth aspect, in the medium transporting device of the thirteenth aspect, the transport drum may be configured to comprise a main body portion and an adsorption sheet. The first adsorption supporting unit and the second adsorption supporting unit may be configured to be formed in the adsorption sheet, and the adsorption sheet may be configured to be fixed by being wrapped around the main body portion.

According to the fourteenth aspect, it is possible to comprise the adsorption sheet according to a size of a medium. Accordingly, it is possible to respond to a plurality of types of media having different sizes.

According to a fifteenth aspect, there is provided a liquid jetting device comprising a liquid jetting head that comprises a plurality of jetting elements and a medium transporting device that transports a medium to which a liquid is jetted from the liquid jetting head. The medium transporting device comprises a gripping unit that comprises a plurality of gripping members which grip a leading end region of a medium in a medium transporting direction, a medium supporting unit that comprises a first adsorption supporting unit which adsorbs and supports a trailing end region of the medium having a length determined in advance in the medium transporting direction from the trailing end of the medium in the medium transporting direction and a second adsorption supporting unit which adsorbs and supports a non-end region, which is a region other than the leading end region and the trailing end region of the medium, the second adsorption supporting unit generating an adsorption pressure less than an adsorption pressure generated by the first adsorption supporting unit, a medium position moving unit that moves a position of the medium in a width direction, which is a direction orthogonal to the medium transporting direction, the medium being supplied to the medium supporting unit, in the width direction, and a medium transporting unit that transports the medium supported by the medium supporting unit in the medium transporting direction. Regarding the width direction, the first adsorption supporting unit has a length in the width direction, which is obtained by adding a length twice a moving distance of the medium by the medium position moving unit to a medium length of a size allowing the first adsorption supporting unit to adsorb and support the trailing end region, and a distance from a center position in the width direction to one end in the width direction is the same as a distance from the center position in the width direction to the other end in the width direction.

According to the fifteenth aspect, it is possible to obtain the same operational effects as the first aspect.

In an aspect of comprising a line-type liquid jetting head, there is restriction of a mechanism, and thus it is difficult to move a position of the line-type liquid jetting head with respect to a position of a wipe sheet. Since a wipe sheet position moving unit moves the position of the wipe sheet, it is possible to move the wipe sheet to a wiping position, which is a position where a liquid is attached to a liquid jetting surface of the line-type liquid jetting head.

In the fifteenth aspect, points which are the same as the points identified in the second aspect to the fourteenth aspect can be combined as appropriate. In this case, configuration elements of the medium transporting device in charge of identified processing or functions can be understood as configuration elements of the liquid jetting device in charge of processing or functions corresponding thereto.

According to a sixteenth aspect, in the liquid jetting device of the fifteenth aspect, the first adsorption supporting unit may be configured to have a length in the width direction, which is obtained by adding a length twice a moving distance of the medium by the medium position moving unit to a medium length of a maximum size allowing the first adsorption supporting unit to adsorb and support the trailing end region, and a distance from a center position in the width direction to one end in the width direction may be configured to be the same as a distance from the center position in the width direction to the other end in the width direction.

According to the sixteenth aspect, it is possible to obtain the same operational effects as the first aspect with the medium having the maximum size allowing the first adsorption supporting unit to adsorb and support the trailing end region.

According to a seventeenth aspect, the liquid jetting device of the fifteenth aspect or the sixteenth aspect may be configured to further comprise a jetting control unit that controls jetting of the liquid jetting head, the jetting control unit changing the jetting elements that jet the liquid in response to movement of the medium in the width direction by the medium position moving unit.

According to the seventeenth aspect, even in a case where the center position of the medium in the width direction of a medium is moved, it is possible that the center position of the medium matches the center position of an image in the width direction of a medium.

According to the present invention, both ends of the medium in the width direction of a medium are supported. In addition, an adsorption pressure to be applied to the medium is uniformized from the center position in the width direction of a medium to both sides in the width direction of a medium, and the occurrence of wrinkling of the medium is suppressed.

DESCRIPTION OF THE PREFERRED EMBODIMENTS

Hereinafter, preferable embodiments of the present invention will be described in detail with reference to the accompanying drawings. In the present specification, the same configuration elements will be assigned with the same reference signs, and overlapping description will be omitted.

Description of Terms

In the present specification, the term "parallel" includes being substantially parallel which intersects but can obtain the same operational effects as being parallel.

The term "orthogonal" includes being substantially orthogonal which intersects at an angle that is less than 90 degrees or an angle that exceeds 90 degrees but can obtain the same operational effects as being orthogonal.

The term "up" means a direction opposite to a gravity direction. The term "down" means the gravity direction.

The term "same" includes being substantially the same which has differences but can obtain the same operational effects as being the same.

[Description of Medium Transporting Device]

<Configuration of Transport Drum>

Figure 1:
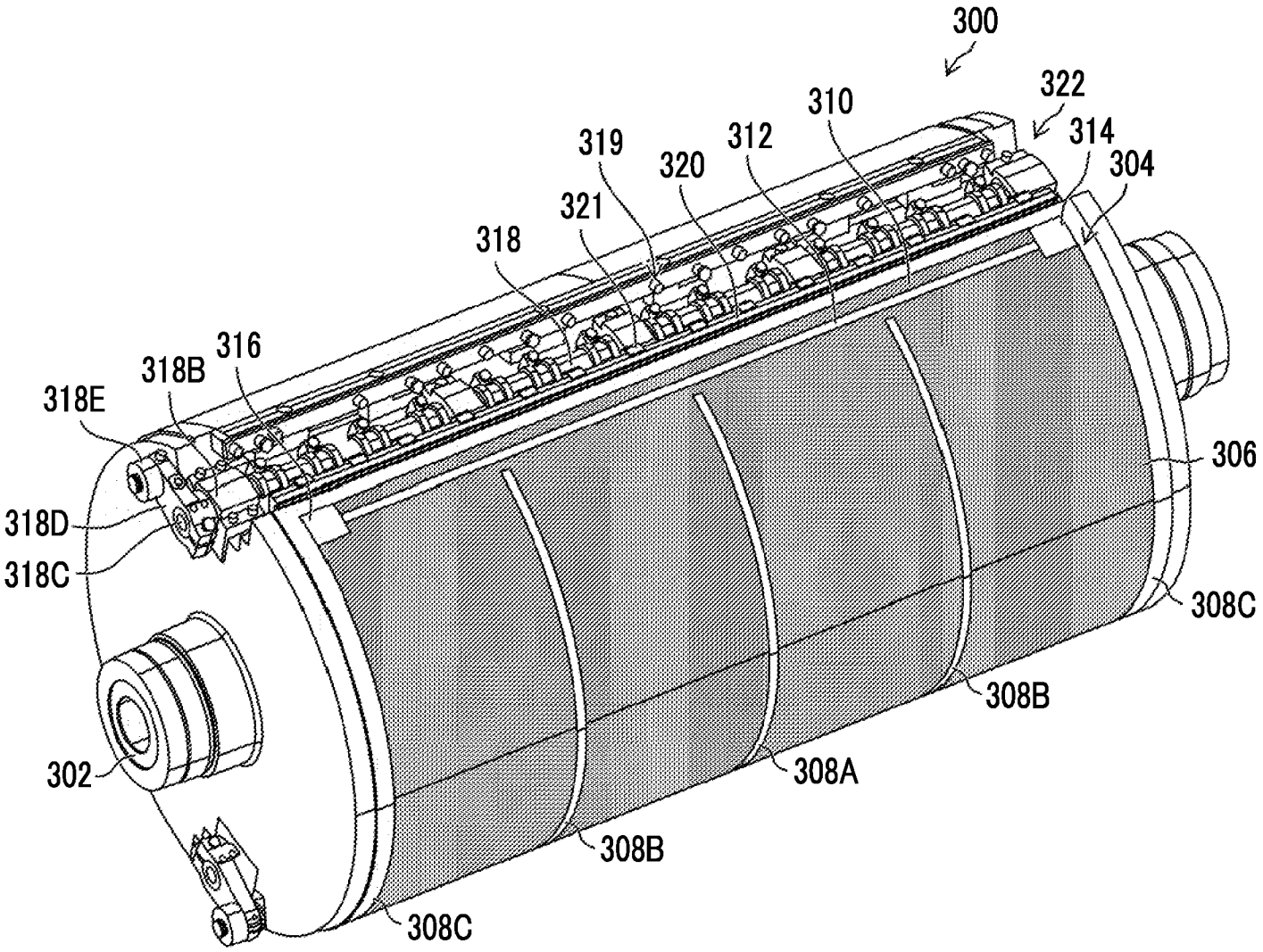
FIG. 1 is a perspective view of a transport drum.

FIG. 1 is a perspective view of a transport drum. A transport drum 300 illustrated in FIG. 1 is a rotating member that is connected to a rotation mechanism (not illustrated) and is configured to be rotatable about a rotary shaft 302, which is supported by a bearing (not illustrated), by operating the rotation mechanism.

Figure 4:
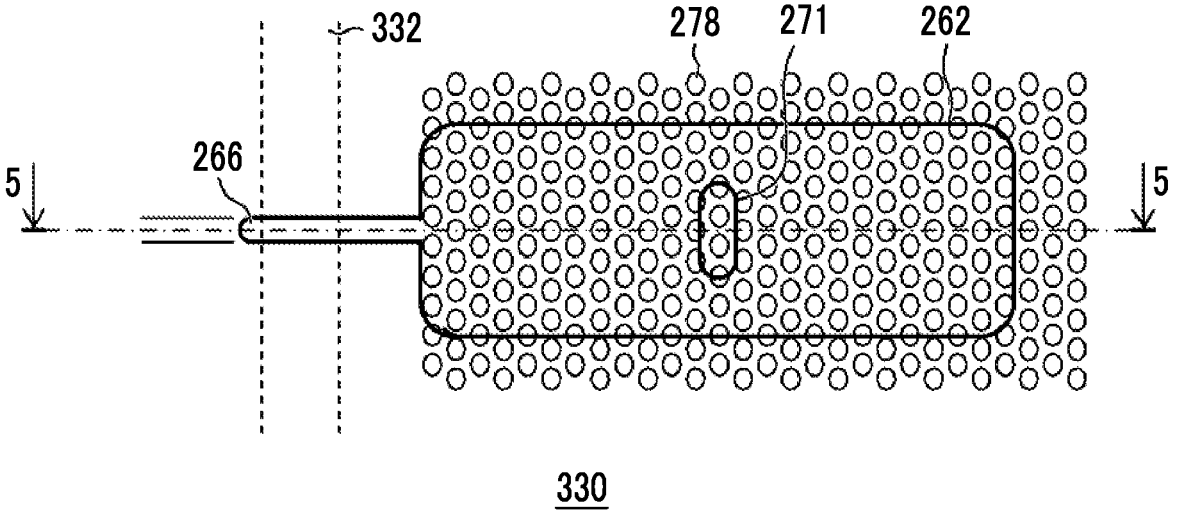
FIG. 4 is a partially enlarged view of the adsorption sheet.

In addition, a medium adsorbing region 306 is provided on a medium supporting surface 304 that supports a medium of the transport drum 300. A plurality of adsorption holes are provided in the medium adsorbing region 306. Illustration of the medium is omitted in FIG. 1. In addition, illustration of the plurality of adsorption holes in the medium adsorbing region 306 is omitted in FIG. 1. The plurality of adsorption holes are illustrated in FIG. 4 with the reference sign 278 assigned.

In the following description, the transport drum in an axial direction of a transport drum and a circumferential direction of a transport drum means the transport drum illustrated in FIG. 1. In addition, the axial direction of a transport drum can be interchangeably used with a medium width direction or a width direction of a medium. The circumferential direction of a transport drum can be interchangeably used with a medium transporting direction.

A non-opening portion 308A is formed in a center position in the axial direction of a transport drum. In addition, non-opening portions 308B are formed at center positions in the axial direction of a transport drum between the center position in the axial direction of a transport drum and both ends in the axial direction of a transport drum. Non-opening portions 308C are formed at both end positions in the axial direction of a transport drum.

The non-opening portion 308A, the non-opening portions 308B, and the non-opening portions 308C each have a fixed width in the axial direction of a transport drum. In addition, the non-opening portion 308A, the non-opening portions 308B, and the non-opening portions 308C are formed along the circumferential direction of a transport drum.

The axial direction of a transport drum is a direction parallel to the rotary shaft of the transport drum 300. The circumferential direction of a transport drum is a direction orthogonal to the axial direction of a transport drum, and is a direction along the medium supporting surface 304 of the transport drum 300.

The non-opening portion 308A, the non-opening portions 308B, and the non-opening portions 308C are formed at positions that allow drum adsorption grooves formed in a drum main body to be covered. In addition, the non-opening portion 308A, the non-opening portions 308B, and the non-opening portions 308C cover at least some of throttle portions.

Figure 2:
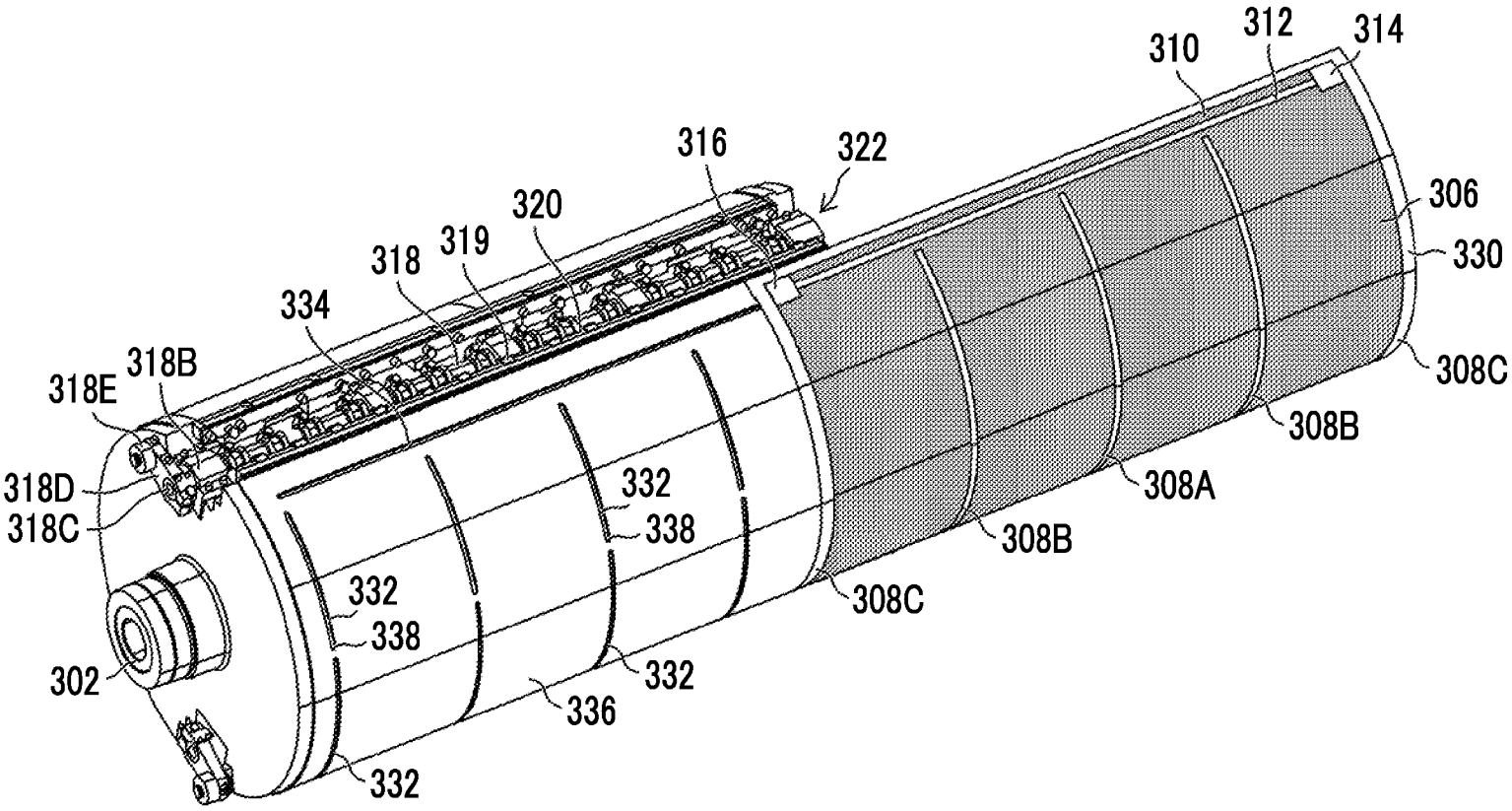
FIG. 2 is an exploded perspective view of the transport drum.
Figure 3:
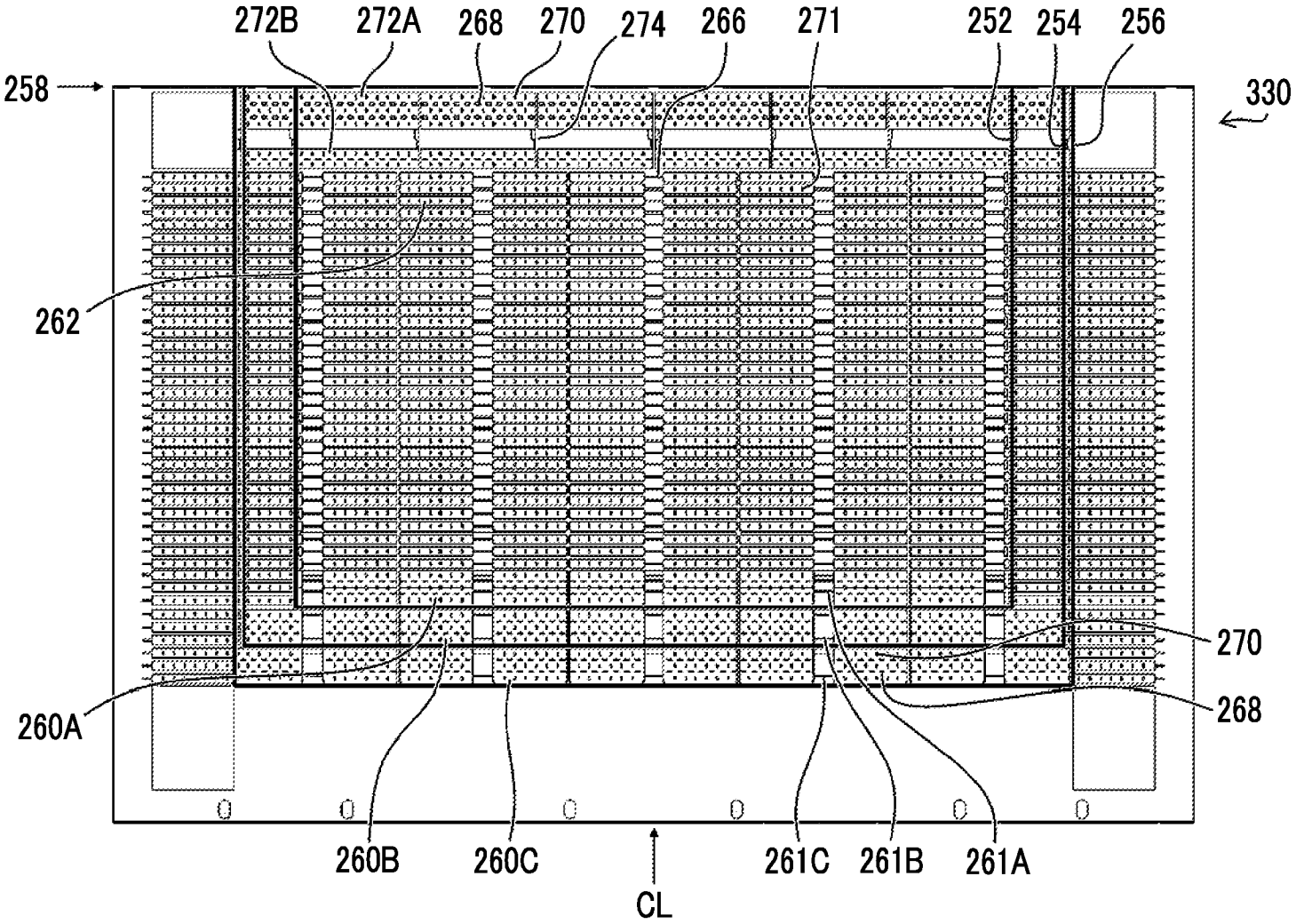
FIG. 3 is a plan view of an adsorption sheet.

Illustration of the drum main body, drum adsorption grooves, and the throttle portions is omitted in FIG. 1. The drum main body is illustrated in FIG. 2 with the reference sign 336 assigned. The drum adsorption grooves are illustrated in FIG. 2 with the reference sign 332 assigned. The throttle portions are illustrated in FIG. 3 with the reference signs 261A, 261B, 261C, and 266 assigned.

A leading end region supporting unit 310 is formed in the medium adsorbing region 306 of the transport drum 300. The leading end region supporting unit 310 is formed at a position that allows a leading end region of a medium to be supported in the medium adsorbing region 306.

The leading end region of the medium is a region having a length determined in advance from a leading end of the medium in a transporting direction of a medium. The leading end of the medium is at a position on the most downstream side of the medium in the transporting direction of a medium. It is possible to determine the length determined in advance according to a type of a medium such as a thickness of a medium. A length that allows to be gripped by a gripper can be given as an example of the length determined in advance.

The leading end region supporting unit 310 is formed along the axial direction of a transport drum. The leading end region supporting unit 310 has a length in the axial direction of a transport drum, which is equal to or larger than a full length in the width direction of a medium.

A non-opening portion 312 is formed in the medium adsorbing region 306. The non-opening portion 312 is formed between the leading end region supporting unit 310 and a non-end region supporting unit in the circumferential direction of a transport drum. The non-end region supporting unit supports a non-end region excluding the leading end region and a trailing end region of a medium.

The non-end region supporting unit is an aspect of a second adsorption supporting unit that generates an adsorption pressure that is less than an adsorption pressure generated by a first adsorption supporting unit. The medium adsorbing region 306 is an aspect of a medium supporting unit.

A full length of the non-opening portion 312 in the axial direction of a transport drum is equal to or larger than a full length in the width direction of a medium, which is the same as the axial direction of a transport drum. The full length of the non-opening portion 312 in the axial direction of a transport drum may be the same as a full length of the leading end region supporting unit 310 in the axial direction of a transport drum.

The non-opening portion 312 is a region where adsorption holes are not formed. The non-opening portion 312 is a region where an adsorption pressure is not generated with respect to a medium. The non-opening portion 312 is formed at a position that allows a leading end drum adsorption groove formed in the drum main body to be covered.

The non-opening portion 312 is disposed at a position that allows at least a part of a throttle portion to be covered. Illustration of the leading end drum adsorption groove and the throttle portion is omitted in FIG. 1. The leading end drum adsorption groove is illustrated in FIG. 2 with the reference sign 334 assigned. The throttle portion is illustrated in FIG. 3 with the reference sign 274 assigned.

A dummy half-etched portion 314 is formed in one end of the leading end region supporting unit 310 in the axial direction of a transport drum. A dummy half-etched portion 316 is formed in the other end of the non-opening portion 312 in the axial direction of a transport drum.

The dummy half-etched portion 314 and the dummy half-etched portion 316 are recessed portions formed in a surface of an adsorption sheet, which is supported on a main body side. The dummy half-etched portion 314 and the dummy half-etched portion 316 do not penetrate the adsorption sheet.

The dummy half-etched portion 314 and the dummy half-etched portion 316 are formed at positions where a medium is not supported in the medium adsorbing region 306. The dummy half-etched portion 314 and the dummy half-etched portion 316 are structures for keeping the stiffness of the entire adsorption sheet uniform.

A flow path (not illustrated) is formed inside a main body portion of the transport drum 300. The flow path is connected to a pipe via a joint comprised in an end surface in the axial direction of a transport drum. Illustration of the joint and the pipe is omitted.

Figure 19:
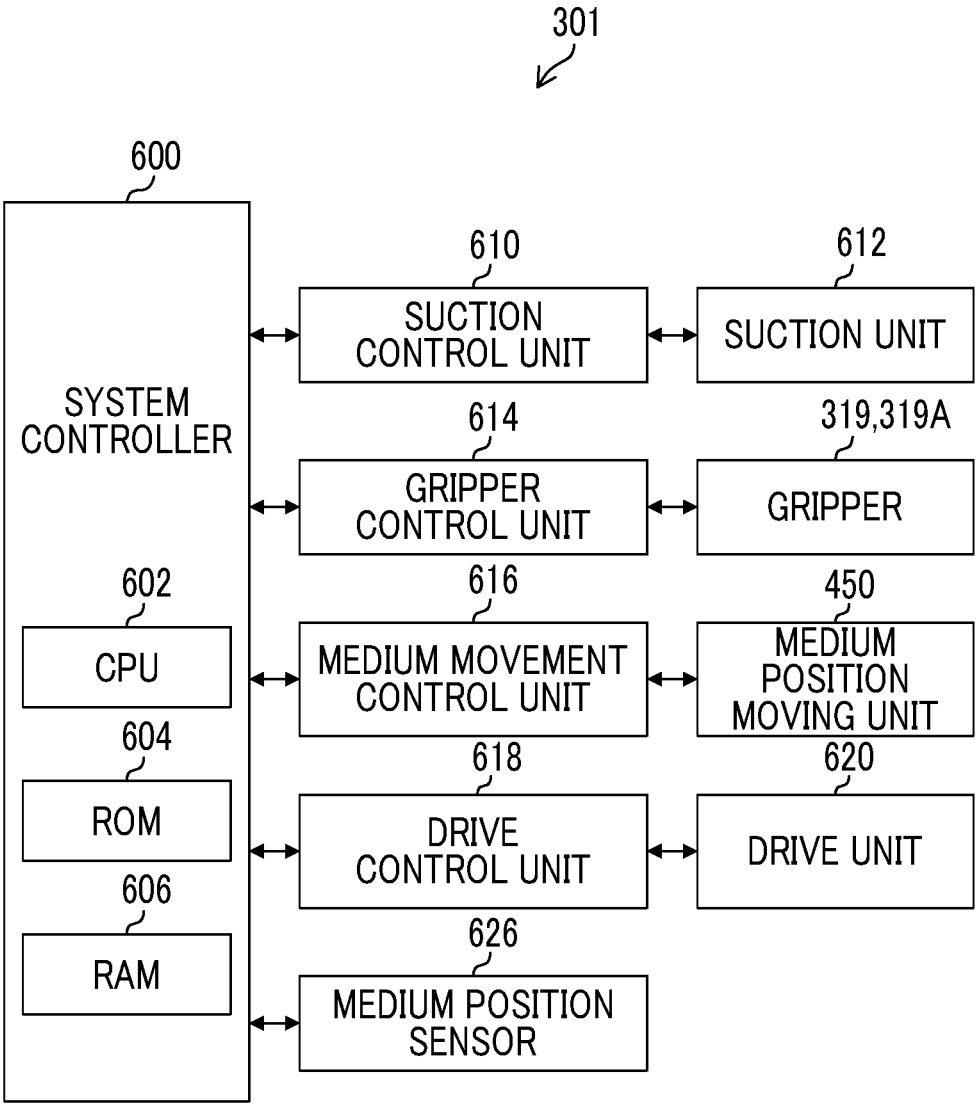
FIG. 19 is a block diagram of a control system.

The pipe is connected to a suction unit via a flow path (not illustrated). A pump may be applied to the suction unit. Illustration of the suction unit is omitted in FIG. 1. The suction unit is shown in FIG. 19 with the reference sign 612 assigned.

Due to operation of the suction unit, the adsorption holes formed in the medium adsorbing region 306 cause a negative pressure via the flow path, the pipe, and the flow path of the main body portion of the transport drum (all of which are not illustrated). It is possible for the transport drum 300 to adsorb and support a medium with the use of the negative pressure caused in the adsorption holes.

The transport drum 300 comprises grippers 319. Each of the grippers 319 is disposed inside a recessed portion 322 formed in an outer circumferential surface of the transport drum 300. The recessed portions 322 where the grippers 319 are arranged at positions separated by a half circumference from each other in the outer circumferential surface of the transport drum 300. In FIG. 1, only one recessed portion 322 is illustrated, and illustration of the other recessed portion 322 is omitted.

The grippers 319 each comprise a plurality of claws 321. The plurality of claws 321 are arranged in the axial direction of a transport drum. The plurality of claws 321 are swingably supported by a gripper base 318.

The gripper base 318 is connected to an opening and closing shaft 318C. The gripper base 318 and the opening and closing shaft 318C are rotatably supported by a shaft bracket 318B.

The opening and closing shaft 318C is connected to a cam follower 318E via an opening and closing arm 318D. Due to the rotation of a cam (not illustrated), the opening and closing shaft 318C and the gripper base 318 swing, and the plurality of claws 321 are opened and closed.

A plurality of claw stands 320 are arranged at positions of opposing the plurality of claws 321. The plurality of claw stands 320 are arranged along the axial direction of a transport drum. A full length of a region, in which the plurality of claw stands 320 are arranged, in the axial direction of a transport drum corresponds to a full length of a region, in which the plurality of claws 321 are arranged, in the axial direction of a transport drum. Positions of the plurality of claws 321 and the plurality of claw stands 320 are fixed.

The grippers 319 each are an aspect of a gripping unit. The plurality of claws 321 and the plurality of claw stands 320 are examples of configuration elements of a gripping member. The claws 321 each are an aspect of a gripping claw.

FIG. 2 is an exploded perspective view of the transport drum. The transport drum 300 comprises an adsorption sheet 330 and a main body portion 336. The transport drum 300 has a structure in which the adsorption sheet 330 is wrapped around an outer circumferential surface of the main body portion 336.

<Main Body Portion>

A plurality of drum adsorption grooves 332 and a leading end drum adsorption groove 334 are formed in the outer circumferential surface of the main body portion 336. The drum adsorption grooves 332 each have a fixed length in a direction parallel to the circumferential direction of a transport drum, which is a direction orthogonal to the axial direction of a transport drum.

The plurality of drum adsorption grooves 332 are arranged to be separated away from each other at a fixed distance in the direction parallel to the circumferential direction of a transport drum, and are arranged to be separated away from each other at a fixed distance along the direction orthogonal to the axial direction of a transport drum.

An aspect, in which two drum adsorption grooves 332 are formed along the direction parallel to the circumferential direction of a transport drum, and five drum adsorption grooves 332 are formed along the direction orthogonal to the axial direction of a transport drum, in a region corresponding to a half circumference of the transport drum 300, is given as an example in FIG. 2.

In FIG. 2, each of the drum adsorption grooves 332 is arranged at a center position in the axial direction of a transport drum, each of both end positions in the axial direction of a transport drum, and each of middle positions between the center position in the axial direction of a transport drum and both end positions in the axial direction of a transport drum. Out of the five drum adsorption grooves 332, one drum adsorption groove 332 is hidden by the medium adsorbing region 306.

A drum adsorption hole 338 is formed in one end of each of the drum adsorption grooves 332 in the circumferential direction. Drum adsorption holes 338 are connected to a flow path (not illustrated) inside the main body portion 336.

In a case where the adsorption sheet 330 is wrapped around the main body portion 336, the leading end drum adsorption groove 334 is disposed at a position of being covered by the non-opening portion 312. A full length of the leading end drum adsorption groove 334 in the axial direction of a transport drum is equal to or smaller than a full length of the non-opening portion 312 in the axial direction of a transport drum.

A leading end drum adsorption hole (not illustrated) is formed in the leading end drum adsorption groove 334. The leading end drum adsorption hole is connected to the flow path (not illustrated) inside the main body portion 336. The flow path connected to the leading end drum adsorption groove 334 may be a dedicated flow path that is different from the flow path connected to the drum adsorption holes 338.

A groove into which a bent portion of the adsorption sheet 330 is inserted is formed in the main body portion 336. In addition, the main body portion 336 comprises a pulling portion that pulls the adsorption sheet 330 in the circumferential direction of a transport drum in a case where the adsorption sheet 330 is wrapped.

The main body portion 336 further comprises a fixing portion that fixes an end of the adsorption sheet 330, which is opposite to the bent portion, to the main body portion 336. Illustration of the groove, the pulling portion, and the fixing portion is omitted.

<Adsorption Sheet>

FIG. 3 is a plan view of the adsorption sheet. In the following description, the axial direction of a transport drum and the circumferential direction of a transport drum, which are shown in FIG. 2, in a state where the adsorption sheet illustrated in FIG. 3 is wrapped around the main body portion 336 illustrated in FIG. 2 will be used as terms to identify directions in the adsorption sheet 330.

A longitudinal direction of the adsorption sheet 330 illustrated in FIG. 3 corresponds to the axial direction of a transport drum. A lateral direction of the adsorption sheet 330 corresponds to the circumferential direction of a transport drum. A position assigned with the reference sign CL is a transporting center. A position assigned with the reference sign 258 is a leading end position in the circumferential direction of a transport drum. A transporting center CL is a center position of the adsorption sheet 330 in the axial direction of a transport drum.

FIG. 3 illustrates a back side of the adsorption sheet 330. In a case where the adsorption sheet 330 is wrapped around the main body portion 336 illustrated in FIG. 2, the back side of the adsorption sheet 330 is a surface on a side of the main body portion 336.

Trailing end adsorption grooves 260A, trailing end adsorption grooves 260B, and trailing end adsorption grooves 260C are formed in the back side of the adsorption sheet 330. The trailing end adsorption grooves 260A each are arranged at a position where a trailing end region of a first size medium is supported in a first support region 252 that supports the first size medium. A trailing end region of a medium is a region having a fixed length from a trailing end of the medium in the transporting direction of a medium. The trailing end of the medium is an end on an upstream side in the transporting direction of a medium.

The first support region 252 illustrated in FIG. 3 has a full length in the axial direction of a transport drum, which exceeds a full length of the first size medium in the width direction. In other words, the plurality of trailing end adsorption grooves 260A in the axial direction of a transport drum have a full length which exceeds the full length of the first size medium in the width direction.

The trailing end adsorption grooves 260B each are arranged at a position where a trailing end region of a second size medium is supported in a second support region 254 that supports the second size medium. The trailing end adsorption grooves 260C each are arranged at a position where a trailing end region of a third size medium is supported in a third support region 256 that supports the third size medium.

The third size medium is a medium having a maximum length in the width direction. The second size medium is a medium having a length in the width direction that is less than the length of the third size medium in the width direction. The first size medium is a medium having a length in the width direction that is less than the length of the second size medium in the width direction.

Figure 6:
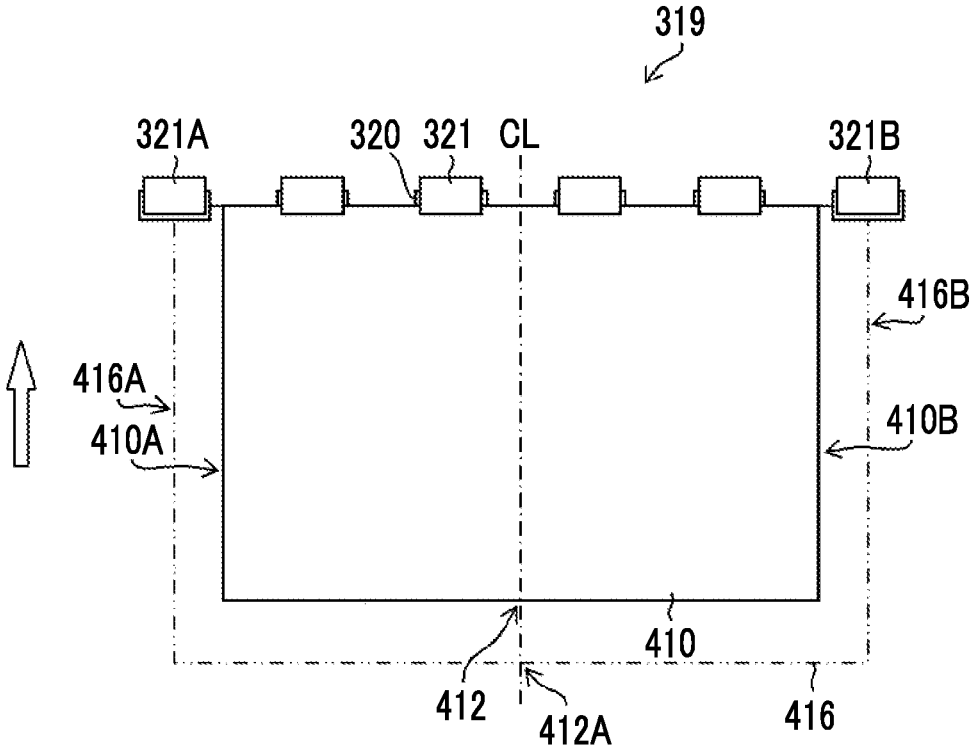
FIG. 6 is an explanatory view of medium transporting according to a comparative example.
Figure 8:
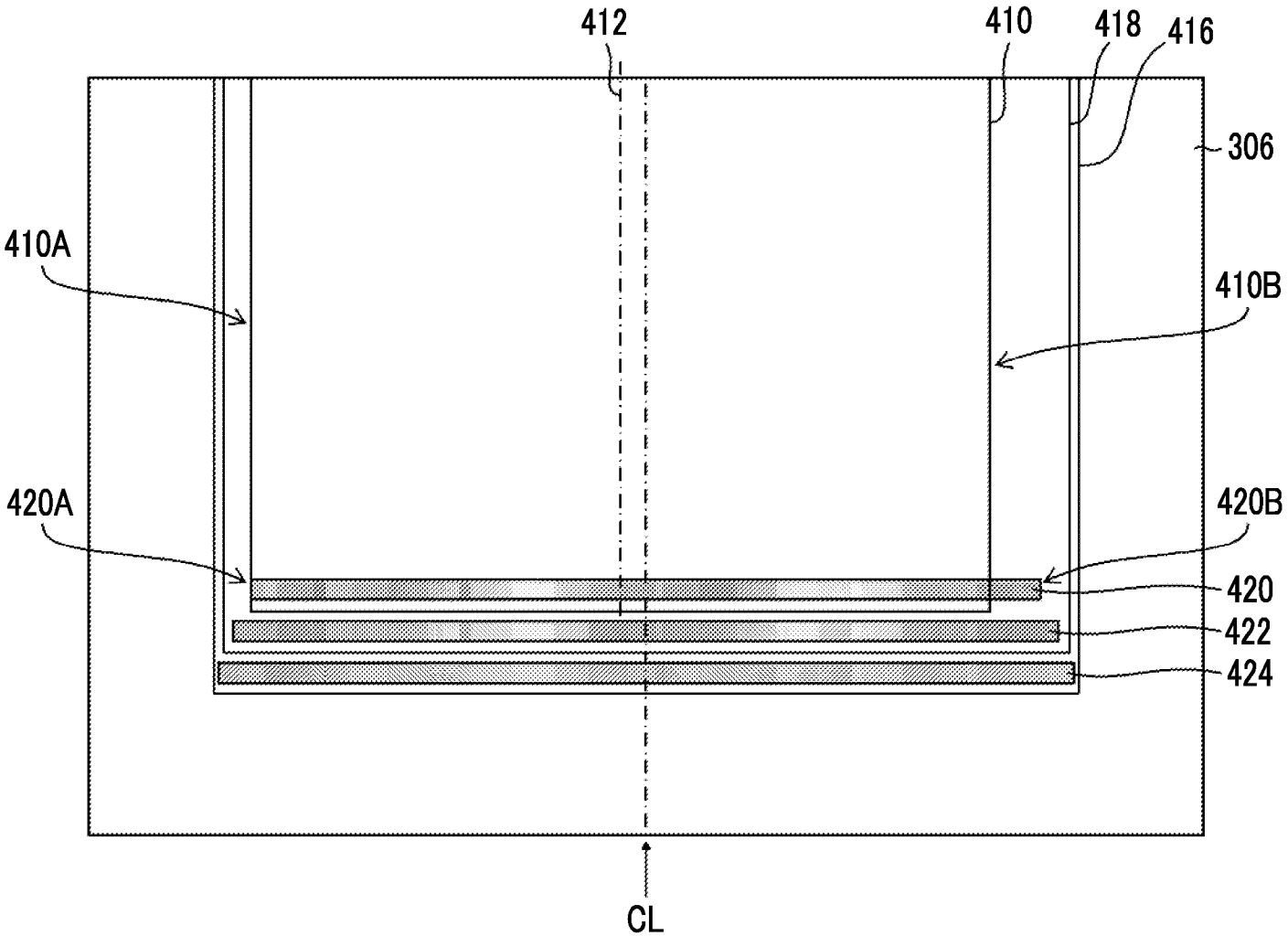
FIG. 8 is a schematic view of a medium adsorbing region.

The first size medium is illustrated with the use of a solid line in FIG. 6 with the reference sign 410 assigned. The second size medium is illustrated in FIG. 8 with the reference sign 418 assigned. The third size medium is illustrated in FIG. 6 with the reference sign 416 assigned.

The trailing end adsorption grooves 260A, the trailing end adsorption grooves 260B, and the trailing end adsorption grooves 260C each have a shape of which a length in the circumferential direction of a transport drum is long compared with non-end adsorption grooves 262. Accordingly, the trailing end adsorption grooves 260A, the trailing end adsorption grooves 260B, and the trailing end adsorption grooves 260C ensure high flow rate per unit length, compared with the non-end adsorption grooves 262.

A plurality of first ribs 268 and a plurality of second ribs 270 are formed in the trailing end adsorption grooves 260A, the trailing end adsorption grooves 260B, and the trailing end adsorption grooves 260C. The first ribs 268 and the second ribs 270 are protrusion portions formed in the trailing end adsorption grooves 260A, the trailing end adsorption grooves 260B, and the trailing end adsorption grooves 260C.

A height of each of the first ribs 268 and the second ribs 270 is equal to or smaller than a thickness of each of the trailing end adsorption grooves 260A, the trailing end adsorption grooves 260B, and the trailing end adsorption grooves 260C. The first ribs 268 each have a fixed length in the axial direction of a transport drum. The second ribs 270 each have a fixed length in the circumferential direction of a transport drum.

The plurality of first ribs 268 are arranged at fixed arrangement intervals along the axial direction of a transport drum and the circumferential direction of a transport drum. The plurality of second ribs 270 are arranged at fixed arrangement intervals along the axial direction of a transport drum and the circumferential direction of a transport drum.

Dents in an arc surface of a medium adsorbed and supported by the adsorption sheet 330, which are generated since the plurality of first ribs 268 and the plurality of second ribs 270 are formed in the trailing end adsorption grooves 260A, the trailing end adsorption grooves 260B, and the trailing end adsorption grooves 260C, can be prevented.

In addition, air can move through gaps between the divided island-shaped first ribs 268 and the divided island-shaped second ribs 270, and thus high flow rate of the air in the trailing end adsorption grooves 260A, the trailing end adsorption grooves 260B, and the trailing end adsorption grooves 260C can be ensured.

The plurality of trailing end adsorption grooves 260A are connected to each other by a plurality of throttle portions 261A. The plurality of trailing end adsorption grooves 260B are connected to each other by a plurality of throttle portions 261B. The plurality of trailing end adsorption grooves 260C are connected to each other by a plurality of throttle portions 261C.

The throttle portions 261A each have a structure in which the trailing end adsorption groove 260A is narrowed. The structure in which the trailing end adsorption groove 260A is narrowed is a structure in which a cross sectional area of each of the throttle portions 261A is less than a cross sectional area of each of the trailing end adsorption grooves 260A. A cross section here is a cross section taken along a cross section line in a lateral direction of the trailing end adsorption grooves 260A and the throttle portions 261A.

Structures of the throttle portions 261B and the throttle portions 261C are the same as the throttle portions 261A. Description of the structures of the throttle portions 261B and the throttle portions 261C is omitted.

The throttle portions 261A, the throttle portions 261B, and the throttle portions 261C are arranged at positions that allow communicating with the drum adsorption grooves 332 illustrated in FIG. 2. Opening portions of the throttle portions 261A, the throttle portions 261B, and the throttle portions 261C are blocked by any one of the non-opening portion 308A, the non-opening portions 308B, or the non-opening portions 308C, which are illustrated in FIG. 2.

The throttle portions 261A, the throttle portions 261B, and the throttle portions 261C, which are illustrated in FIG. 3, each have a structure of being covered by any one of the non-opening portion 308A, the non-opening portions 308B, or the non-opening portions 308C, which are illustrated in FIG. 2, and of not being directly open to the atmosphere.

It is preferable that a width of each of the throttle portions 261A, the throttle portions 261B, and the throttle portions 261C be 0.2 millimeters or more and 5.0 millimeters or less. It is more preferable that a width of each of the throttle portions 261A, the throttle portions 261B, and the throttle portions 261C be 1.0 millimeter or more and 3.0 millimeters or less. It is preferable that a length of each of the throttle portions 261A, the throttle portions 261B, and the throttle portions 261C in the axial direction of a transport drum be 2.0 millimeters or more and 10.0 millimeters or less.

The throttle portions 261A, the throttle portions 261B, and the throttle portions 261C each have a structure in which a cross sectional area thereof is larger than throttle portions 266 connected to the non-end adsorption grooves 262. The throttle portions 261A, the throttle portions 261B, and the throttle portions 261C may each have a length in the axial direction of a transport drum, which is smaller than the throttle portions 266 connected to the non-end adsorption grooves 262.

The throttle portions 261A, the throttle portions 261B, and the throttle portions 261C may each have a depth that is larger than the throttle portions 266 connected to the non-end adsorption grooves 262.

Due to the structure of the adsorption sheet 330 illustrated in FIG. 3, the flow rate per unit length of a region that adsorbs a trailing end region of a medium can be made higher than the flow rate per unit length of a region that adsorbs a non-end region of the medium.

Accordingly, an adsorption pressure of a trailing end region of a medium can be further increased, and it is possible to efficiently adsorb a trailing end region of a thick medium, or a trailing end region of a highly stiff medium.

A non-end region of a medium is a region excluding a leading end region of the medium and a trailing end region of the medium. A middle region of a medium can be given as an example of the non-end region of the medium. The middle region of the medium is a region including a center position of the medium in the transporting direction of a medium, and a center position of the medium in the width direction of a medium.

The plurality of non-end adsorption grooves 262 are formed in the back side of the adsorption sheet 330. The plurality of non-end adsorption grooves 262 are arranged to be separated away from each other at a fixed distance along the axial direction of a transport drum. The plurality of non-end adsorption grooves 262 are arranged to be separated away from each other at a fixed distance along the circumferential direction of a transport drum.

The non-end adsorption grooves 262 each have a structure in which a length thereof in the circumferential direction of a transport drum is short compared to the trailing end adsorption grooves 260A, the trailing end adsorption grooves 260B, and the trailing end adsorption grooves 260C. Third ribs 271, each of which has a fixed length in the circumferential direction of a transport drum, are formed inside the non-end adsorption grooves 262.

A shape and arrangement of each of the third ribs 271 are the same as the second ribs 270. Detailed description of the shape and the arrangement of each of the third ribs 271 is omitted.

Both ends of each of the non-end adsorption grooves 262 in the axial direction of a transport drum are connected to the throttle portions 266. A structure and arrangement of each of the throttle portions 266 are the same as the throttle portions 261A, the throttle portions 261B, and the throttle portions 261C. Detailed description of the structure and the arrangement of each of the throttle portions 266 is omitted.

A plurality of first leading end adsorption grooves 272A and a plurality of second leading end adsorption grooves 272B are formed in the back side of the adsorption sheet 330. The plurality of first leading end adsorption grooves 272A are arranged in the axial direction of a transport drum. The plurality of second leading end adsorption grooves 272B are arranged in the axial direction of a transport drum.

The plurality of first leading end adsorption grooves 272A and the plurality of second leading end adsorption grooves 272B are arranged in the circumferential direction of a transport drum from a leading end position 258 in the circumferential direction of a transport drum, in order of the plurality of first leading end adsorption grooves 272A and the plurality of second leading end adsorption grooves 272B.

The plurality of first leading end adsorption grooves 272A and the plurality of second leading end adsorption grooves 272B are connected to each other via a throttle portion 274. The throttle portion 274 has a fixed length in the circumferential direction of a transport drum. A structure of the throttle portion 274 is the same as the throttle portions 261A, the throttle portions 261B, and the throttle portions 261C. Detailed description of the structure of the throttle portion 274 is omitted.

A length of each of the first leading end adsorption grooves 272A in the circumferential direction of a transport drum is twice a length of each of the second leading end adsorption grooves 272B in the circumferential direction of a transport drum.

The first ribs 268 and the second ribs 270 are formed in the first leading end adsorption grooves 272A and the second leading end adsorption grooves 272B. A shape and arrangement of each of the first ribs 268 and the second ribs 270 are the same as the first ribs 268 and the second ribs 270 formed in the trailing end adsorption grooves 260A, the trailing end adsorption grooves 260B, and the trailing end adsorption grooves 260C.

Detailed description of the shape and the arrangement of each of the first ribs 268 and the second ribs 270 formed in the first leading end adsorption grooves 272A and the second leading end adsorption grooves 272B is omitted.

The first leading end adsorption grooves 272A are formed at a position of the leading end region supporting unit 310 illustrated in FIG. 1. The throttle portion 274 is disposed at a position of the non-opening portion 312. The second leading end adsorption grooves 272B are arranged at positions between a position of the non-opening portion 312 and the region that adsorbs a non-end region of a medium.

Since the adsorption sheet comprises the first leading end adsorption grooves 272A and the second leading end adsorption grooves 272B, the flow rate per unit length of a region that adsorbs a leading end region of a medium can be made higher than the flow rate per unit length of the region that adsorbs a non-end region of the medium.

Accordingly, an adsorption pressure of the leading end region of the medium can be further increased, and thus it is possible to efficiently adsorb a leading end region of a thick medium, or a leading end region of a highly stiff medium.

The plurality of adsorption holes are formed in a front side of the adsorption sheet 330 although illustration thereof is omitted in FIG. 3. The adsorption holes are illustrated in FIG. 4 with the reference sign 278 assigned. The first leading end adsorption grooves 272A and the second leading end adsorption grooves 272B may be replaced with the non-end adsorption grooves 262.

It is possible to change the structure of the adsorption sheet 330 illustrated in FIG. 3 according to a size of a medium to be used. The adsorption sheet 330 is prepared for each medium to be used, and the adsorption sheet 330 may be changed in a case where a medium to be used is changed.

FIG. 4 is a partially enlarged view of the adsorption sheet. FIG. 4 illustrates the front side of the adsorption sheet 330. FIG. 4 illustrates an arrangement relationship among adsorption holes 278, the non-end adsorption grooves 262, and the throttle portion 266.

An arrangement relationship among the adsorption holes 278, the trailing end adsorption grooves 260A, the trailing end adsorption grooves 260B, the trailing end adsorption grooves 260C, the throttle portions 261A, the throttle portions 261B, and the throttle portions 261C, which are illustrated in FIG. 3, is the same as the arrangement relationship among the adsorption holes 278, the non-end adsorption grooves 262, and the throttle portion 266, which are illustrated in FIG. 4.

In addition, an arrangement relationship among the adsorption holes 278 illustrated in FIG. 4, the first leading end adsorption grooves 272A, the second leading end adsorption grooves 272B, and the throttle portion 274, which are illustrated in FIG. 3 is the same as the arrangement relationship among the adsorption holes 278, the non-end adsorption grooves 262, and the throttle portions 266, which are illustrated in FIG. 4.

The adsorption holes 278 illustrated in FIG. 4 each are an aspect of a second adsorption hole. The adsorption holes formed at positions of the trailing end adsorption grooves 260A, the trailing end adsorption grooves 260B, and the trailing end adsorption grooves 260C, which are illustrated in FIG. 3, each are an aspect of a first adsorption hole.

The plurality of adsorption holes 278 are formed in the front side of the adsorption sheet 330 illustrated in FIG. 4. The adsorption holes 278 are arranged in the medium adsorbing region 306 illustrated in FIG. 1. A planar shape of each of the adsorption holes 278 is a circular shape in a case of being seen from the front side of the adsorption sheet 330. A shape other than a circular shape, including an elliptical shape and a polygonal shape, may be applied to the planar shape of each of the adsorption holes 278 in a case of being seen from the front side of the adsorption sheet 330.

In a case where the planar shape of each of the adsorption holes 278 in a case of being seen from the front side of the adsorption sheet 330 is a circular shape, it is preferable that a diameter of each of the adsorption holes 278 be 1.5 millimeters or more and 2.0 millimeters or less. It is possible to determine a shape, a quantity, and an arrangement interval of each of the adsorption holes 278 from a perspective of an adsorption pressure to be applied to a medium and stiffness of an adsorption sheet.

On the other hand, the adsorption holes 278 are not formed in regions where the throttle portions 266 are formed. In the regions where the throttle portions 266 are formed, the non-opening portion 308A, the non-opening portions 308B, and the non-opening portions 308C, which are illustrated in FIG. 1, are formed.

Figure 5:
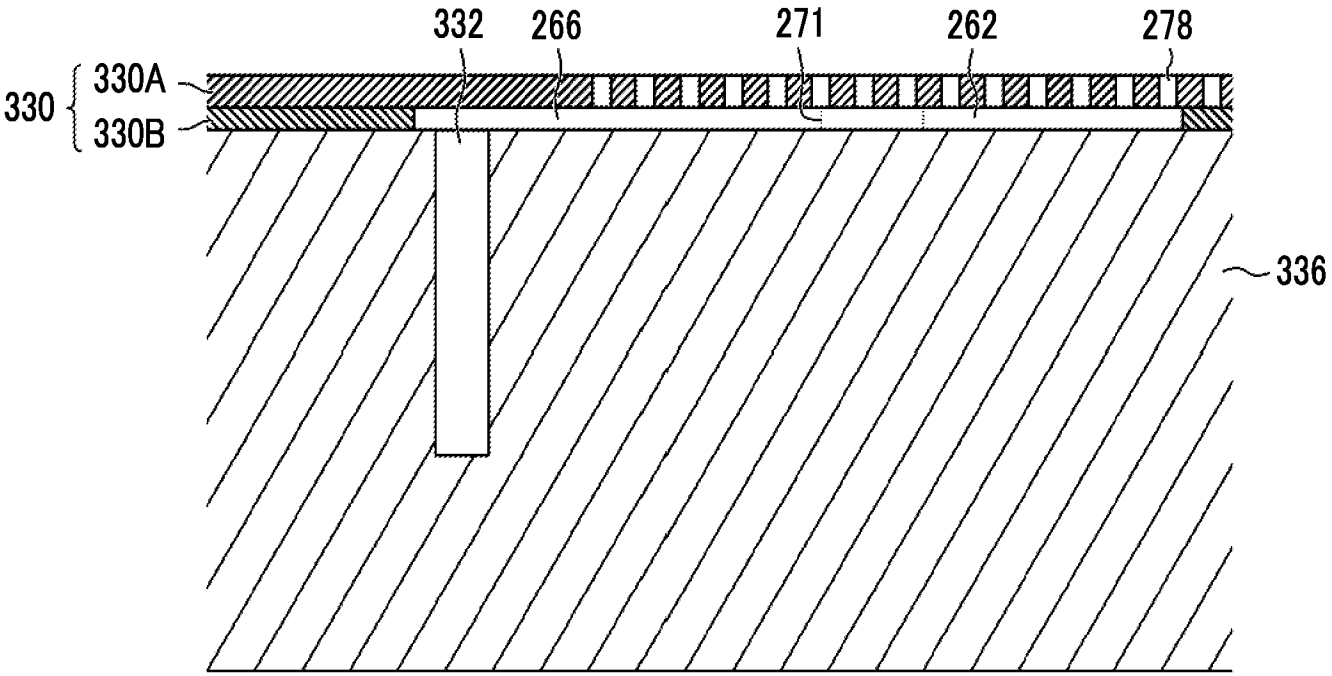
FIG. 5 is a cross sectional view of the transport drum, which is taken along cross section line 5-5 shown in FIG. 4.

FIG. 5 is a cross sectional view of the transport drum, which is taken along cross section line 5-5 shown in FIG. 4. The adsorption sheet 330 illustrated in FIG. 5 has a two-layer structure of comprising an adsorption hole layer 330A and an adsorption groove layer 330B. The adsorption sheet 330 may be one sheet in which the adsorption holes 278 are formed from a front side, and the non-end adsorption grooves 262 are formed from the back side.

Stainless steel is applicable to a material of the adsorption sheet 330. In a case where a material other than stainless steel is applied to the adsorption sheet 330, a thickness of the adsorption sheet 330 is determined in consideration of the stiffness and softness of a material to be applied to the adsorption sheet 330.

Although the transport drum 300 described with reference to FIGS. 1 to 5 has a structure in which the adsorption sheet 330 is wrapped around the main body portion 336, the transport drum may have a configuration where the main body portion 336 and the adsorption sheet 330 are integrated.

The integral structure here includes an aspect in which the main body portion 336 illustrated in FIG. 2 and the adsorption sheet 330 illustrated in FIG. 3 are bonded to each other such that the main body portion 336 illustrated in FIG. 2 and the adsorption sheet 330 illustrated in FIG. 3 cannot be separated.

[Description of Medium Transporting According to First Embodiment]

Figure 7:
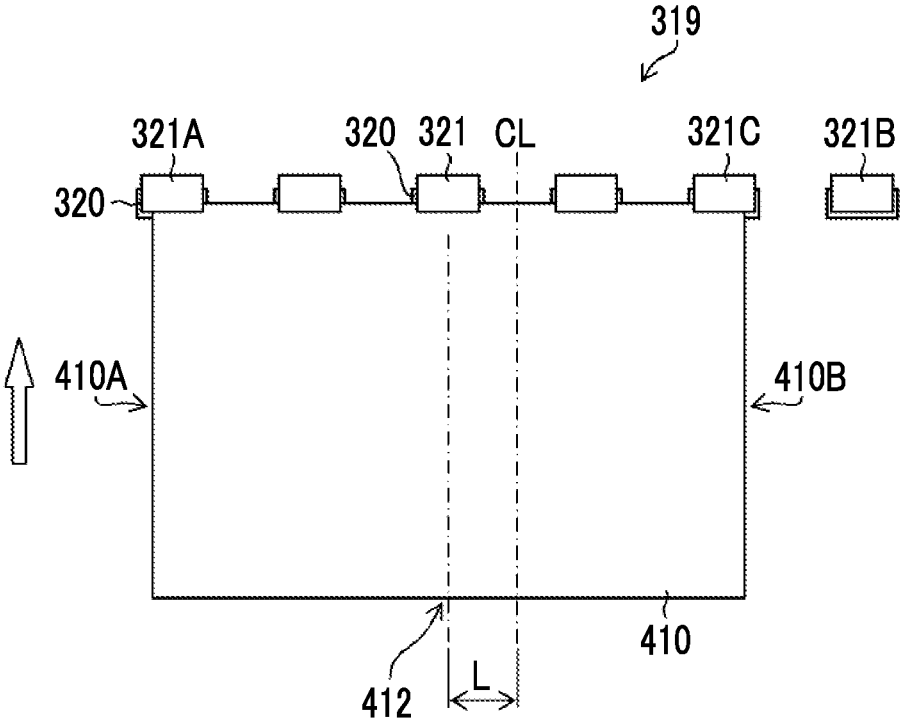
FIG. 7 is a schematic view of a case where a center position in a width direction of a medium is moved in the width direction of a medium.

FIG. 6 is an explanatory view of medium transporting according to a comparative example. FIG. 7 is an explanatory view of medium transporting according to the embodiment. FIG. 6 illustrates a case where a center position 412 of a medium 410 in a width direction matches the transporting center CL. An arrow line shown in FIG. 6 indicates the medium transporting direction. The same applies to FIGS. 7, 11, and 13.

The medium 410 illustrated with a solid line in FIG. 6 is the first size medium. In a case where the center position 412 in the width direction matches the transporting center CL, one end 410A and the other end 410B of the first size medium 410 in the width direction are not gripped.

In a case where a center position 412A of a third size medium 416, which is illustrated with a two-dot chain line, in the width direction matches the transporting center CL, one end 416A in a width direction is gripped by a claw 321A. In addition, the other end 416B is gripped by a claw 321B. The same applies to the second size medium (not illustrated).

FIG. 7 is a schematic view of a case where the center position in the width direction of a medium is moved in the width direction of a medium. The center position 412 of the first size medium 410, which is illustrated in FIG. 7, in the width direction is moved from the transporting center CL to a side of the one end 410A of the first size medium 410 in the width direction of a medium. A moving distance of the center position 412 of the first size medium 410 in the width direction is indicated with L. A moving distance L of the medium is determined in advance according to a size of a medium.

The one end 410A of the first size medium 410 in the width direction, which is illustrated in FIG. 7, is gripped by the claw 321A. The other end 410B of the first size medium 410 in the width direction is gripped by a claw 321C. Details of a medium moving unit that moves the first size medium 410 in the width direction will be described later.

FIG. 8 is a schematic view of the medium adsorbing region. In FIG. 8, the medium adsorbing region 306 illustrated in FIG. 1 is illustrated by being developed in a plane. A first trailing end adsorbing region 420 that adsorbs a trailing end region of the first size medium 410 is formed in the medium adsorbing region 306 illustrated in FIG. 8.

A second trailing end adsorbing region 422 that adsorbs a trailing end region of a second size medium 418 is formed in the medium adsorbing region 306. A third trailing end adsorbing region 424 that adsorbs a trailing end region of the third size medium 416 is formed in the medium adsorbing region 306.

The first trailing end adsorbing region 420, the second trailing end adsorbing region 422, and the third trailing end adsorbing region 424 are regions that each have a relatively strong adsorption pressure to be applied to a medium compared to other regions in the medium adsorbing region 306.

A position of the first trailing end adsorbing region 420 corresponds to the positions of the trailing end adsorption grooves 260A illustrated in FIG. 3. A position of the second trailing end adsorbing region 422 illustrated in FIG. 8 corresponds to the positions of the trailing end adsorption grooves 260B illustrated in FIG. 3. A position of the third trailing end adsorbing region 424 illustrated in FIG. 8 corresponds to the positions of the trailing end adsorption grooves 260C illustrated in FIG. 3.

A full length of the first trailing end adsorbing region 420 in the medium width direction is a length that exceeds the full length of the first size medium 410 in the width direction. In addition, a position of one end 420A of the first trailing end adsorbing region 420 in the medium width direction corresponds to a position of a claw gripping the one end of the first size medium 410 in the width direction. A position of the other end 420B of the first trailing end adsorbing region 420 in the medium width direction corresponds to a position of a claw gripping the other end of the first size medium 410 in the width direction.

The positions of the claws here are any positions in a region where the claws can grip the medium in the axial direction of a transport drum. The claw 321A illustrated in FIG. 7 can be given as an example of the claw that grips the one end 410A of the first size medium 410 in the width direction. The claw 321C illustrated in FIG. 7 can be given as an example of the claw that grips the other end 410B of the first size medium 410 in the width direction.

In addition, a distance from the one end 420A to the transporting center CL in the medium width direction in the first trailing end adsorbing region 420 is the same as a distance from the other end 420B to the transporting center CL in the medium width direction in the first trailing end adsorbing region 420. The first trailing end adsorbing region 420 is an aspect of a first adsorption supporting unit.

A full length of the second trailing end adsorbing region 422 in the medium width direction, which is illustrated in FIG. 8, is equal to or smaller than a full length of the second size medium 418 in the width direction. Similarly, a full length of the third trailing end adsorbing region 424 in the medium width direction, which is illustrated in FIG. 8, is equal to or smaller than a full length of the third size medium 416 in the width direction.

In a case where the center positions of the second size medium 418 and the third size medium 416 in the width direction are aligned with the transporting center CL, both ends of the second size medium and the third size medium in the width direction are gripped by claws. The second trailing end adsorbing region 422 and the third trailing end adsorbing region 424 each are an aspect of a third adsorption supporting unit.

Figure 9:
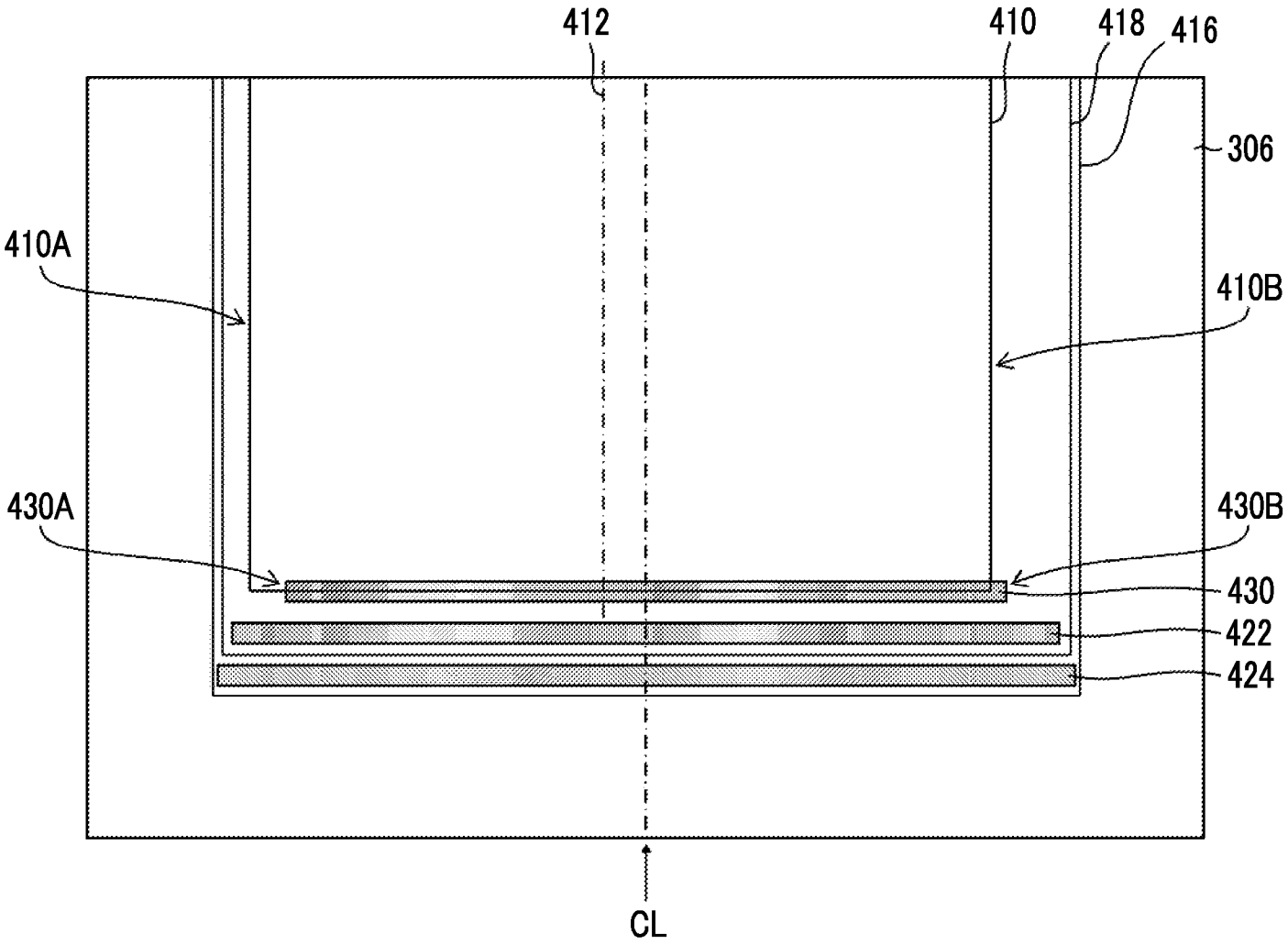
FIG. 9 is a schematic view of a medium adsorbing region according to a comparative example.

FIG. 9 is a schematic view of a medium adsorbing region according to a comparative example. A full length of a first trailing end adsorbing region 430, which is illustrated in FIG. 9, in the medium width direction is equal to or smaller than the full length of the first size medium 410 in the width direction. In addition, in the first trailing end adsorbing region 430, a distance from one end 430A to the transporting center CL in the medium width direction is the same as a distance from the other end 430B to the transporting center CL in the medium width direction.

In a case where the first size medium 410 is moved in the width direction, the one end 410A of the first size medium 410 in the width direction is shifted away from the first trailing end adsorbing region 420. Then, the lifting of the one end 410A of the first size medium 410 in the width direction is likely to occur.

Figure 10:
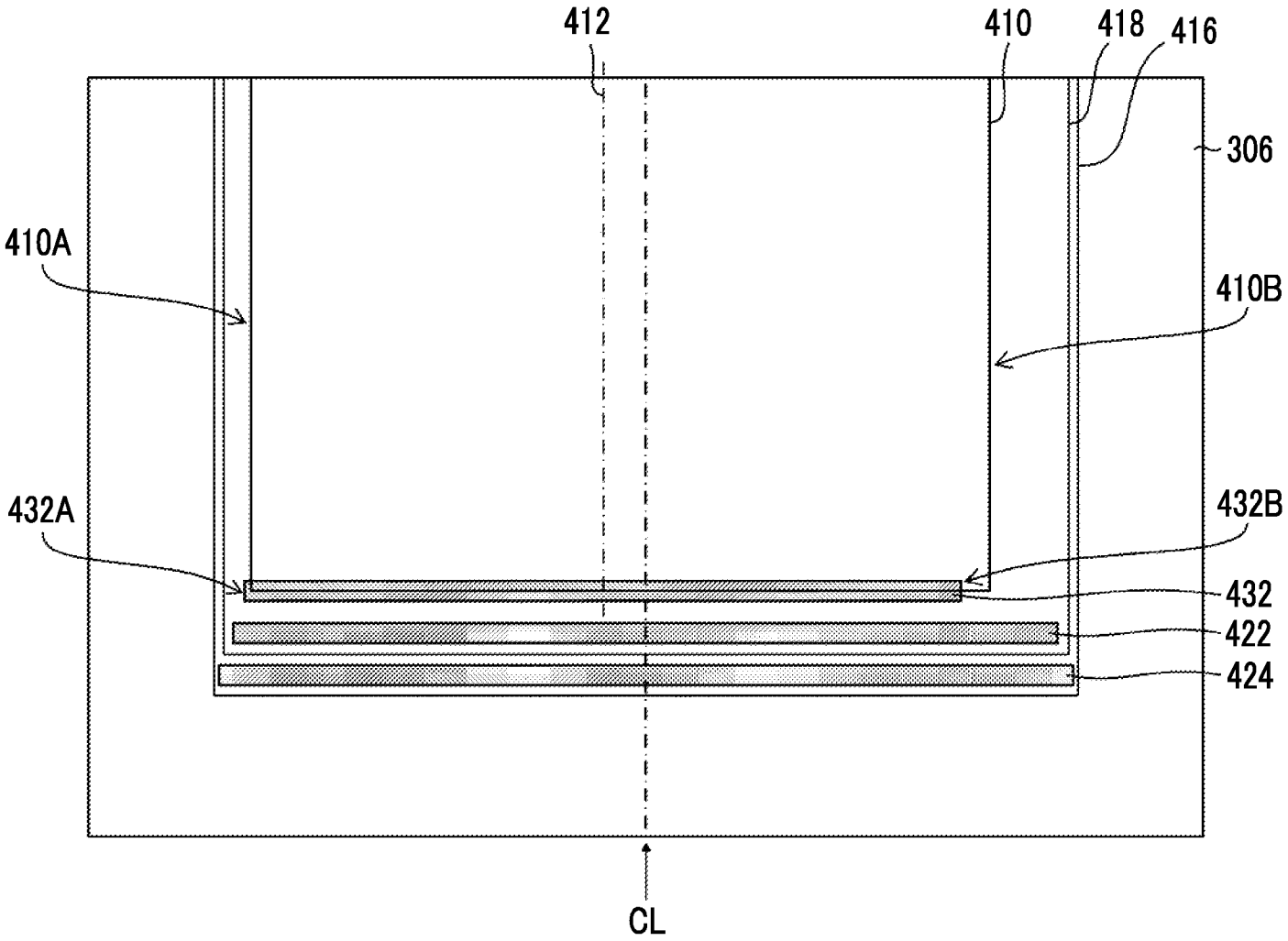
FIG. 10 is a schematic view of a medium adsorbing region according to another comparative example.

FIG. 10 is a schematic view of a medium adsorbing region according to another comparative example. A first trailing end adsorbing region 432 illustrated in FIG. 10 is obtained by extending the first trailing end adsorbing region 430 illustrated in FIG. 9 to a side of the one end 430A to which the first size medium 410 moves.

That is, a full length of the first trailing end adsorbing region 432 in the medium width direction is a length that exceeds the full length of the first size medium 410 in the width direction. The full length of the first trailing end adsorbing region 432 in the medium width direction is a length obtained by adding a moving distance of the first size medium 410 to the full length of the first size medium 410 in the width direction. Accordingly, it is possible to adsorb the entire first size the medium 410 in the width direction in the first trailing end adsorbing region 432.

In the first trailing end adsorbing region 432, a distance from one end 432A to the transporting center CL in the medium transporting direction is different from a distance from the other end 432B to the transporting center CL. Then, in the first trailing end adsorbing region 432, a difference between an adsorption pressure on one side of the medium width direction and an adsorption pressure on the other side of the medium width direction with the transporting center CL as reference occurs, and thus the wrinkling of a medium is likely to occur.

On the other hand, the first trailing end adsorbing region 420 illustrated in FIG. 8 has a length in the medium width direction that exceeds the full length of the first size medium 410 in the width direction. In addition, the distance from the one end 420A to the transporting center CL in the first trailing end adsorbing region 420 is the same as the distance from the other end 420B to the transporting center CL in the first trailing end adsorbing region 420.

A length obtained by subtracting the full length of the first size medium 410 in the width direction from the full length of the first trailing end adsorbing region 420 in the medium width direction is twice or more a moving distance of the first size medium 410 in the width direction. In other words, the full length of the first trailing end adsorbing region 420 in the medium width direction is a length obtained by adding twice the moving distance of the first size medium 410 in the width direction to the full length of the first size medium 410 in the width direction.

In the first trailing end adsorbing region 420, a trailing end region of a medium having a size smaller than the full length of the first size medium 410 in the width direction, the medium being a medium of which at least one of one end or the other end in the width direction is not gripped in a case where a center position of the medium in the width direction is aligned with the transporting center, may be adsorbed and supported. The medium, which is the first size medium 410, is an aspect of a medium having a maximum size that can be supported by the first trailing end adsorbing region 420.

[Configuration Example of Medium Moving Unit]

Figure 11:
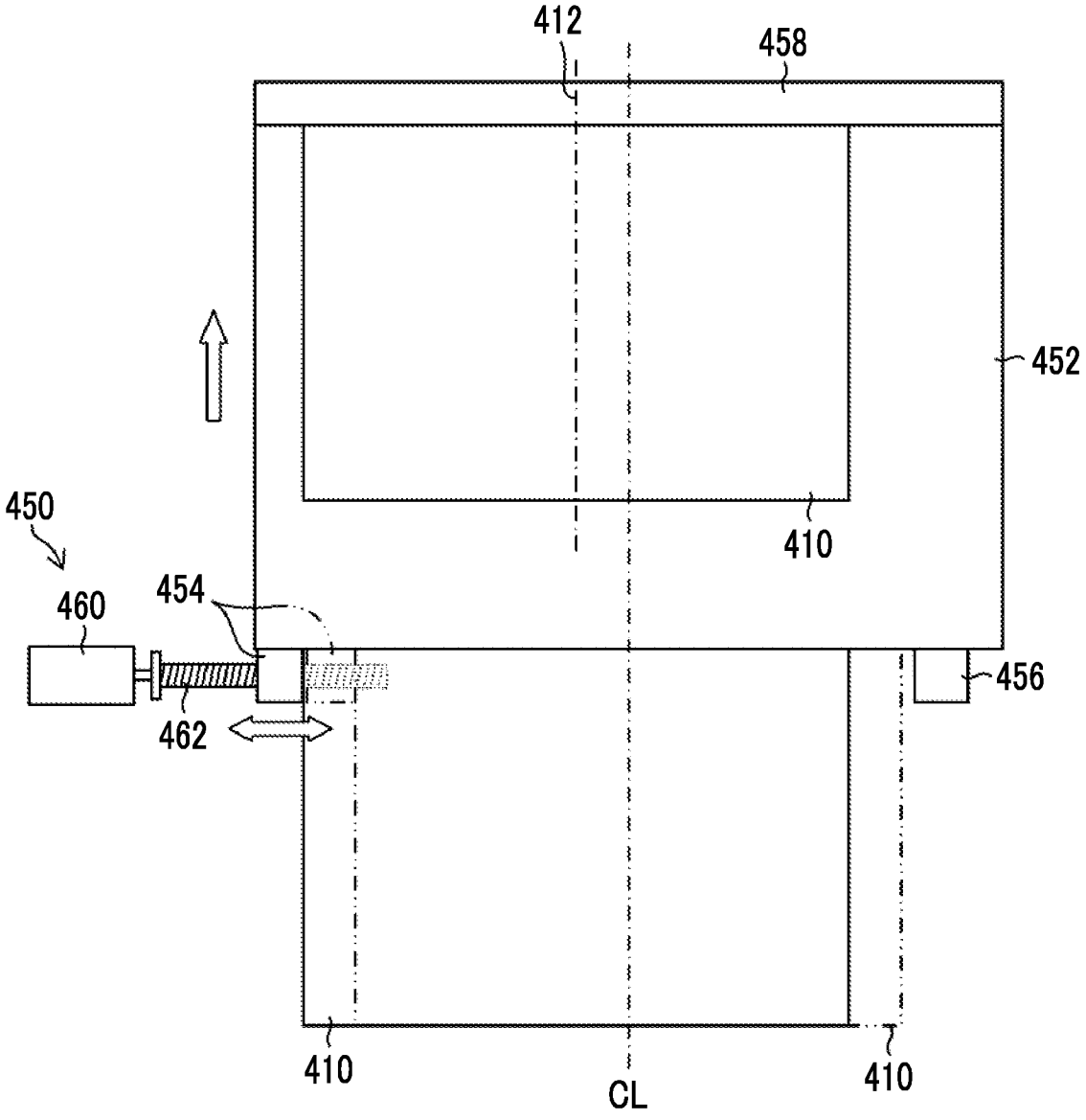
FIG. 11 is an explanatory view of a configuration example of a medium moving unit.

FIG. 11 is an explanatory view of a configuration example of the medium moving unit. A medium transporting guide 452 that guides a medium to the transport drum 300 illustrated in FIG. 1 comprises a medium position moving unit 450 illustrated in FIG. 11. The medium here is a general term for the first size medium 410 illustrated in FIG. 6, the second size medium 418 illustrated in FIG. 8, and the third size medium 416 illustrated in FIG. 6.

Out of the first size medium 410, the second size medium 418, and the third size medium 416, a medium which needs to be moved in the width direction is the first size medium 410.

The medium transporting guide 452 comprises a first positioning guide 454 and a second positioning guide 456 that determine a position of an end of a medium in the medium width direction. The medium transporting guide 452 comprises a third positioning guide 458 that determines a position of a leading end of a medium.

The medium position moving unit 450 illustrated in FIG. 11 comprises a motor 460 and a linear motion mechanism 462. A ball screw can be given as an example of the linear motion mechanism 462. The first positioning guide 454 illustrated in FIG. 11 is reciprocably supported by the linear motion mechanism 462.

By operating the motor 460, it is possible to reciprocate the first positioning guide 454 in the medium width direction. A double arrow line shown in FIG. 11 is a reciprocating movement direction of the first positioning guide 454.

In a case of supplying the first size medium 410 to the transport drum 300 illustrated in FIG. 1, the motor 460 illustrated in FIG. 11 is operated, and the first positioning guide 454 is moved in the medium width direction so as to correspond to a moving distance of the first size medium 410.

The first size medium 410 is guided by the first positioning guide 454 and moves in the width direction. After then, the first size medium 410 guided by the first positioning guide 454 moves to a position where the leading end thereof collides with the third positioning guide 458.

The medium position moving unit 450 may move the second positioning guide 456, or may move both of the first positioning guide 454 and the second positioning guide 456. A sheet feeding unit that supplies a medium to the transport drum 300 illustrated in FIG. 1 can be given as an example of a place for mounting the medium position moving unit 450 illustrated in FIG. 11. A feeder board 36 illustrated in FIG. 20 can be given as another example of a place for mounting the medium position moving unit 450 illustrated in FIG. 11.

In a case where the transport drum 300 described with reference to FIGS. 1 to 11 is applied to a medium transporting device of an image forming apparatus, image data is shifted in the width direction of a medium in response to movement in the width direction of a medium, and a corresponding relationship between an image and a nozzle unit is changed. The image data may be image data before halftone processing, or maybe image data after halftone processing. The shift of the image data can be executed by a drawing control unit 118 shown in FIG. 21.

The image here includes an image formed on a medium with the use of a color ink. The image may have a planar shape or a three-dimensional shape formed with the use of a liquid containing resin particles and metal particles. The shape can include concepts called a pattern and a figure.

Figure 21:
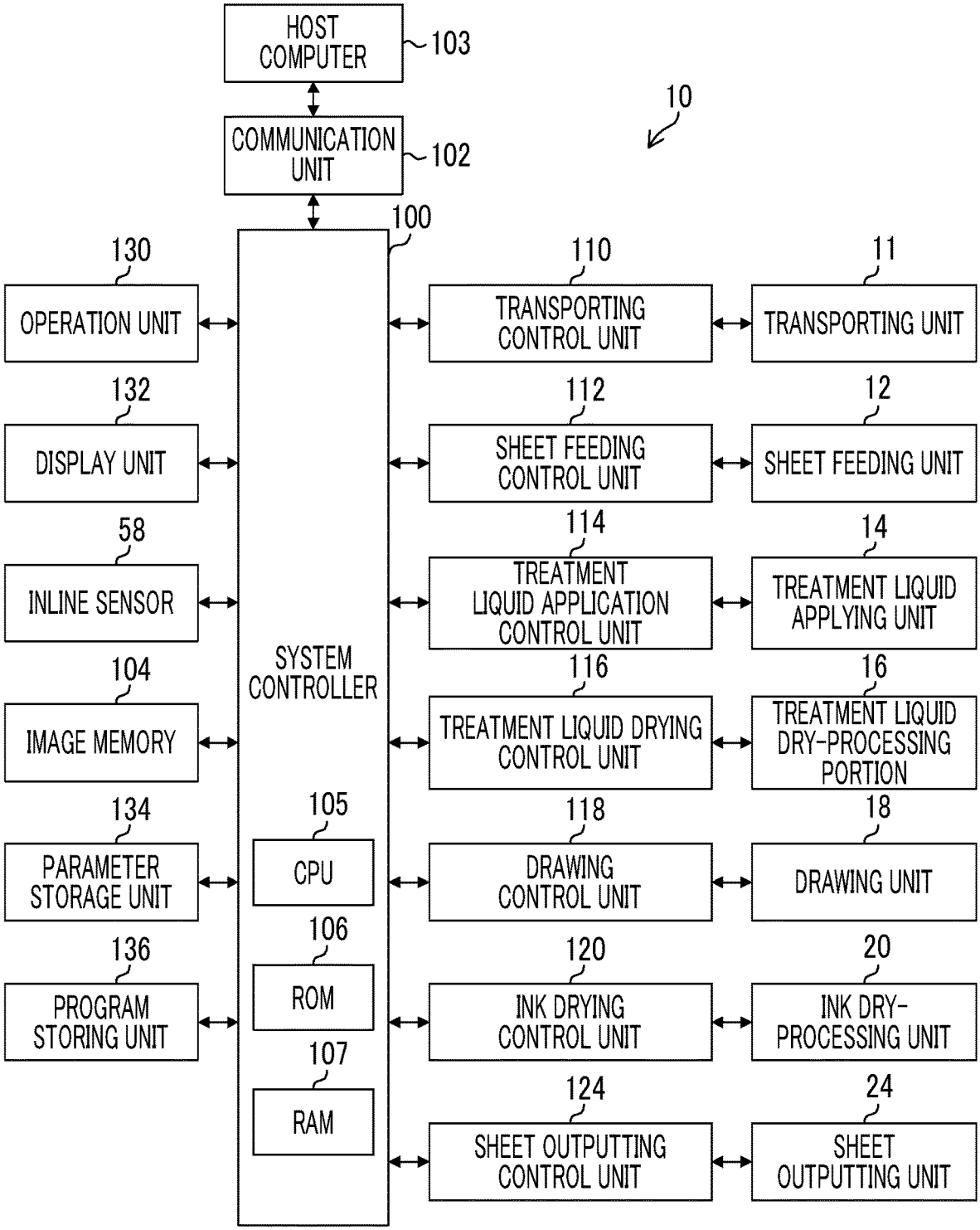
FIG. 21 is a block diagram of a control system of an ink jet recording device illustrated in FIG. 20.

The drawing control unit 118 shown in FIG. 21 is an aspect of a jetting control unit that changes a jetting element, which jets a liquid, in response to medium movement in the width direction by the medium moving unit. The nozzle unit is an aspect of the jetting element.

[Operational Effects of First Embodiment]

In the medium transporting device according to the first embodiment, the full length of the first trailing end adsorbing region 420, in which the trailing end region of the first size medium 410 is adsorbed and supported, in the medium width direction is a length obtained by adding twice the moving distance of the first size medium 410 in the width direction to the full length of the first size medium 410 in the width direction.

Accordingly, in a case where the first size medium 410 is shifted in the width direction in order to align the position of the one end 410A of the first size medium 410 in the width direction with the positions of the claws 321 of the grippers 319, both ends of the first size medium 410 in the width direction do not come into a free state since the claws 321 of the grippers 319 are used.

Thus, it is possible to support both ends of the first size medium 410 in the width direction, and it is possible to adsorb and support the trailing end region of the first size medium 410 over the full length of the trailing end region in the width direction with the use of the first trailing end adsorbing region 420.

In addition, the lengths from both end positions in the medium width direction to the transporting center are the same in the first trailing end adsorbing region 420. Accordingly, an adsorption pressure that is generated in the first trailing end adsorbing region 420 is uniformized in the medium width direction, and thus the occurrence of wrinkling of the medium is suppressed.

A configuration where a medium is adsorbed and supported by the outer circumferential surface of the transport drum 300, which is described in the embodiment, is an example, and the medium may be adsorbed and supported by the outer circumferential surface of the transport drum 300 with the use of another configuration. In addition, another configuration may also be applied to the structures of the first trailing end adsorbing region 420, the second trailing end adsorbing region 422, and the third trailing end adsorbing region 424.

For example, a configuration where a total area of the plurality of adsorption holes per unit area in the first trailing end adsorbing region 420, the second trailing end adsorbing region 422, and the third trailing end adsorbing region 424 exceeds a total area of the plurality of adsorption holes per unit area in a non-end region supporting region can be adopted.

In a case where there are two or more types of media moved in the medium width direction and the media have different lengths in the medium transporting direction from each other, the medium adsorbing region 306 may comprise two or more types of the first trailing end adsorbing regions 420 illustrated in FIG. 8. In a case of comprising the plurality of first trailing end adsorbing regions 420, the plurality of first trailing end adsorbing regions 420 are arranged along the medium transporting direction.

Although the first size medium 410 is moved to the side of the one end 410A in the width direction in the embodiment, the first size medium 410 may be moved to a side of the other end 410B in the width direction.

[Description of Medium Transporting According to Second Embodiment]

Figure 12:
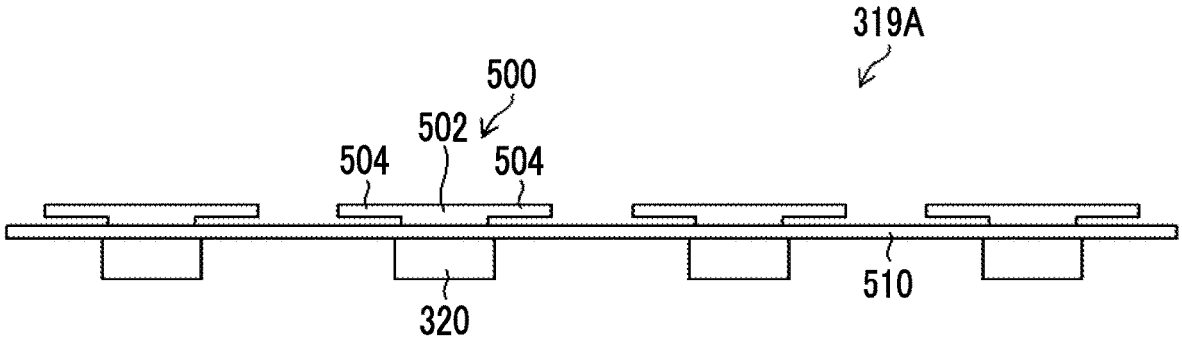
FIG. 12 is a schematic view of supporting of a medium by an overhanging claw.
Figure 13:
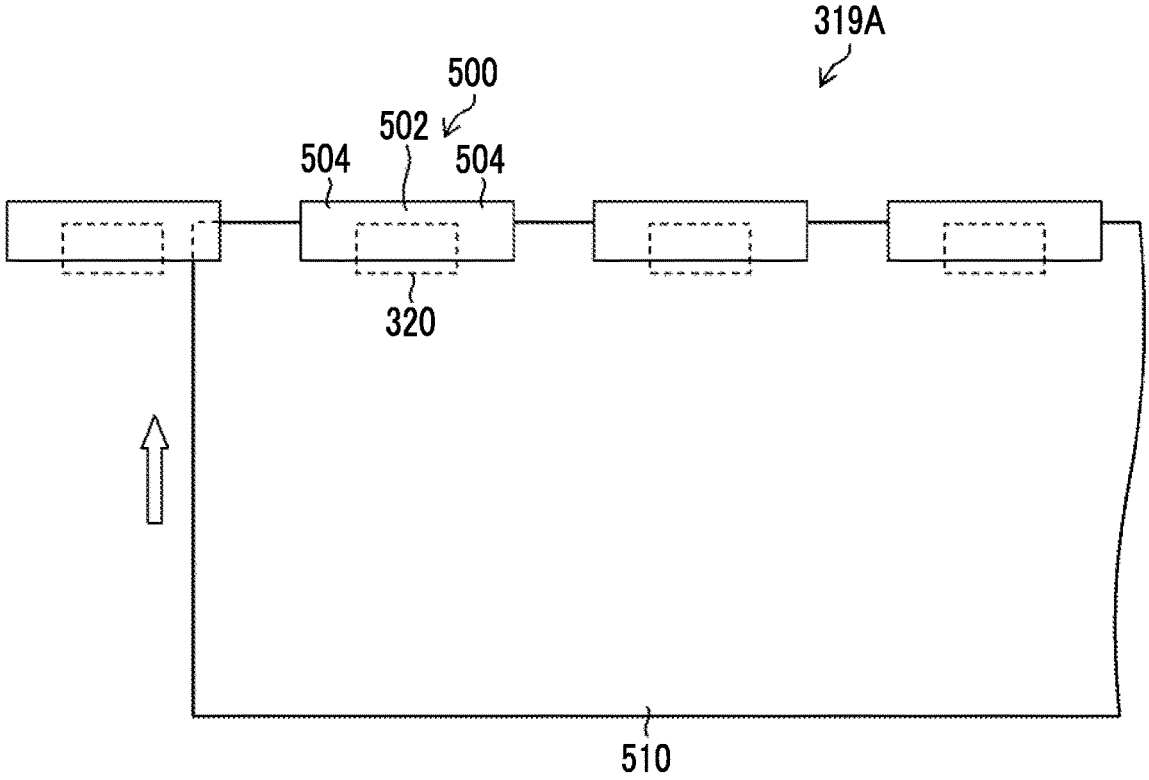
FIG. 13 is a plan view of FIG. 12.

Next, medium transporting according to a second embodiment will be described. FIG. 12 is a schematic view illustrating supporting of a medium by an overhanging claw. A direction that penetrates the page of FIG. 12 from a front side to a back side is the medium transporting direction. FIG. 13 is a plan view of FIG. 12. FIGS. 12 and 13 illustrate a state where a medium 510 is gripped by overhanging claws 500.

A gripper 319A illustrated in FIG. 12 comprises the plurality of overhanging claws 500. The gripper 319A may comprise at least one overhanging claw 500. The overhanging claws 500 are arranged at positions corresponding to the position of the one end 410A or the other end 410B of the first size medium 410.

Each of the overhanging claws 500 comprises a gripping region 502 and overhanging regions 504. In each of the overhanging claws 500 illustrated in FIG. 12, the overhanging regions 504 are formed on both sides of the gripping region 502 in the axial direction of a transport drum. The overhanging region 504 may be formed on only one side of the gripping region 502 in the axial direction of a transport drum.

The overhanging regions 504 are recessed by approximately 0.2 millimeters from a contact position with the claw stand 320 or a medium compared to the gripping region 502. In other words, a thickness of each of the overhanging regions 504 is made thinner by approximately 0.2 millimeters than a thickness of the gripping region 502.

Figure 14:
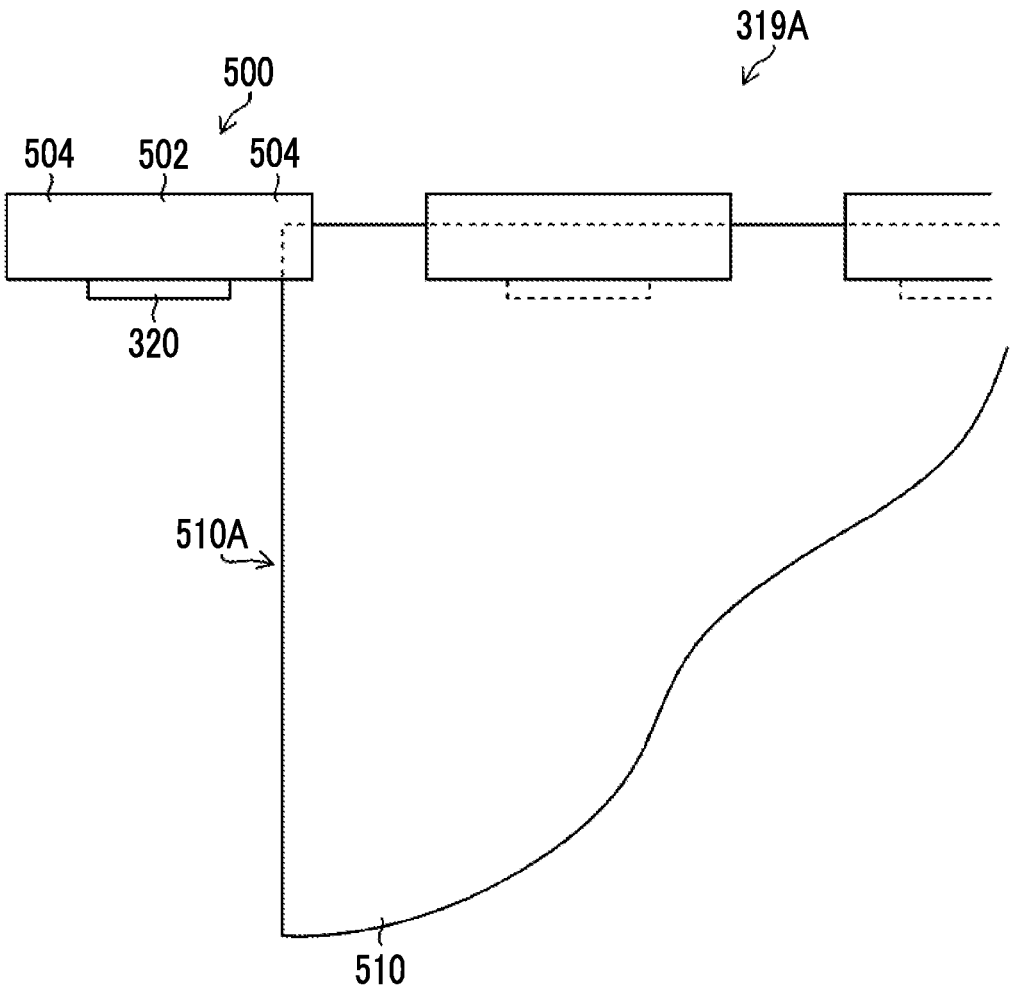
FIG. 14 is a partially enlarged view of FIG. 13.

FIG. 14 is a partially enlarged view of FIG. 13. As illustrated in FIG. 14, it is possible for the overhanging region 504 to support one end 510A of the medium 510 in the width direction while the medium 510 is not gripped.

That is, the one end 510A of the medium 510 in the width direction is not gripped by the overhanging claws 500. However, even in a case where the one end 510A of the medium 510 is lifted, it is possible for the overhanging region 504 to press the lifted one end 510A of the medium 510.

In a case where an arrangement interval between the overhanging claws 500 in the axial direction of a transport drum and an arrangement interval between the claw stands 320 in the axial direction of a transport drum are 35 millimeters, and a full length of each of the claw stands 320 in the axial direction of a transport drum is 20 millimeters, it is possible to make a length of each of the overhanging regions 504 in the axial direction of a transport drum 5 millimeters or more and 10 millimeters or less.

Arrangement of the overhanging claws 500 and the claw stands 320, which are described above, allows avoiding interference between the gripper 319A illustrated in FIG. 14 and a gripper that receives or delivers the medium 510.

[Operational Effects of Second Embodiment]

In a case where the one end 510A of the medium 510 in the width direction is not gripped by the gripping region 502 of the overhanging claw 500 since the gripper 319A that grips a leading end of the medium 510 comprises at least one overhanging claw 500, the one end 510A of the medium 510 in the width direction is supported by the overhanging region 504. Accordingly, the lifting of the one end 510A of the medium 510 in the width direction is suppressed.

In addition, it is suppressed that the medium 510 is sandwiched between the overhanging regions 504 and the claw stand 320 since the overhanging regions 504 are recessed by approximately 0.2 millimeters compared to the gripping region 502. Accordingly, the deformation of the medium 510 can be suppressed.

Although the one end 510A of the medium 510 in the width direction is described in the embodiment, the overhanging claws 500 are comprised at the other end 510B of the medium 510 in the width direction, and thus it is possible to obtain the same operational effects. The other end 510B of the medium 510 in the width direction is illustrated in FIG. 15.

The overhanging claws 500 each are an aspect of a wide claw. The overhanging regions 504 each are an aspect of a non-gripping region that does not grip a medium between a claw stand and the overhanging claw. The gripping region 502 is an aspect of a gripping region having a projecting shape with respect to the non-gripping region.

[Specific Example of Movement in Width Direction of Medium]

Figure 15:
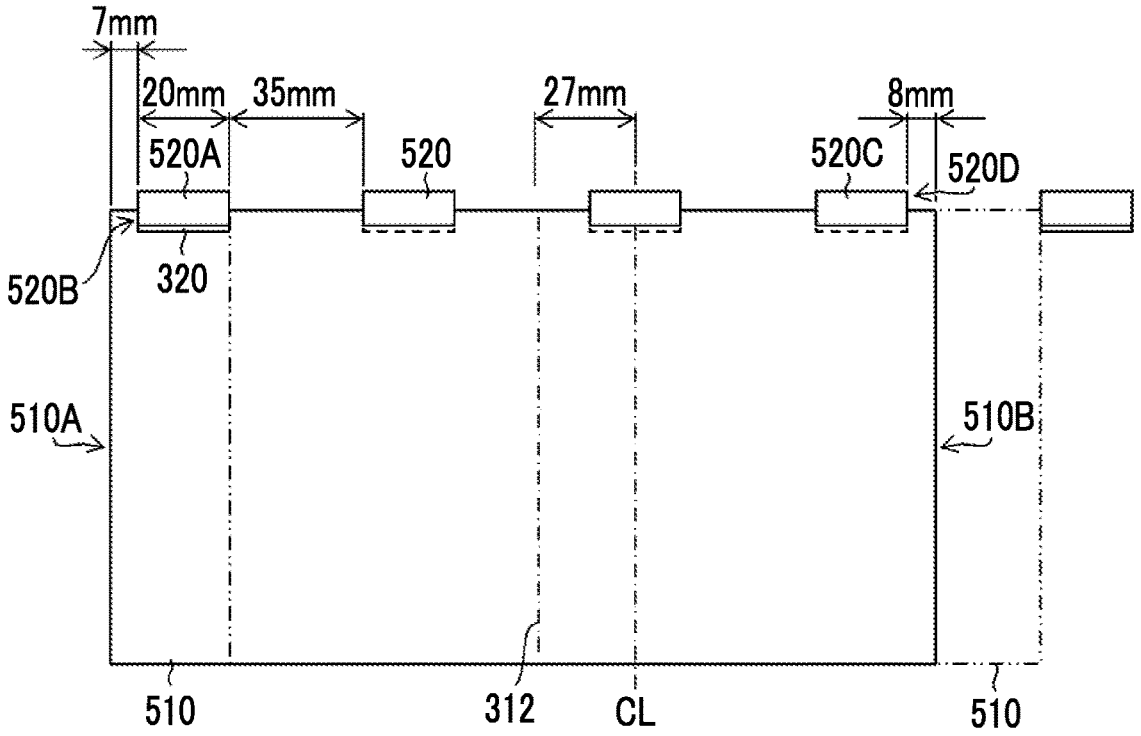
FIG. 15 is a schematic view of gripping of the medium by a normal claw.
Figure 16:
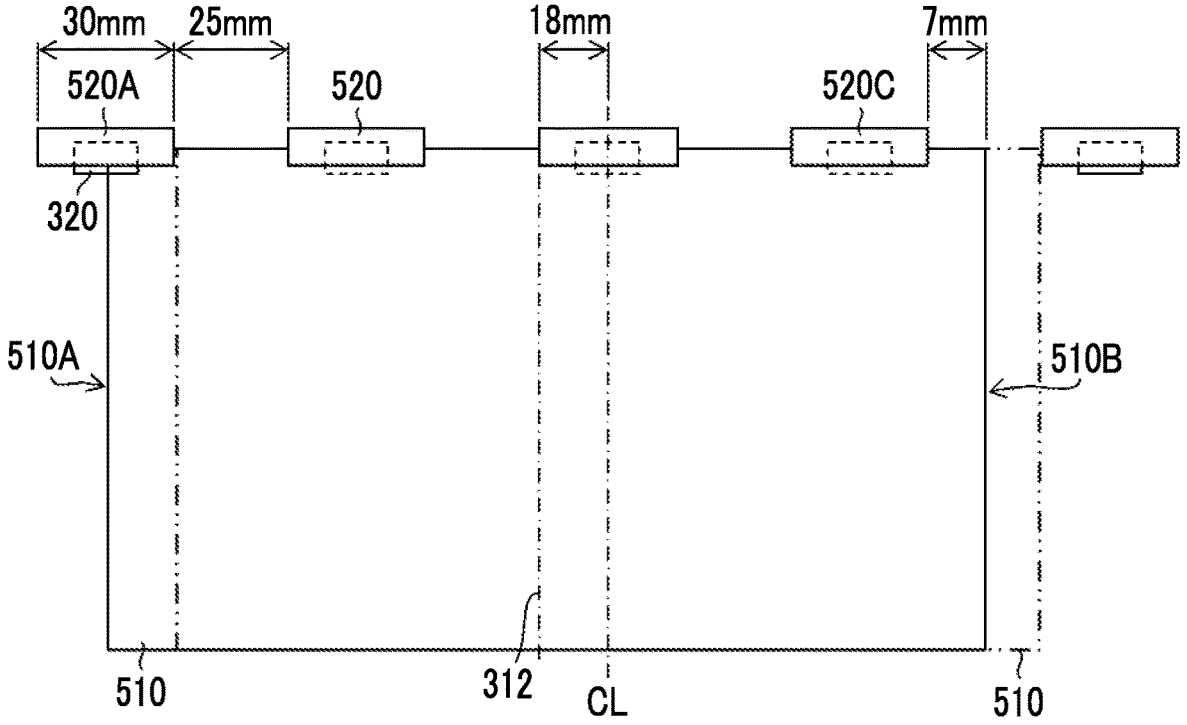
FIG. 16 is a schematic view of gripping of the medium by the overhanging claw.

FIG. 15 is a schematic view of gripping of a medium by normal claws. The claws 321 illustrated in FIG. 6 are given as examples of normal claws 520 illustrated in FIG. 15. FIG. 16 is a schematic view of gripping of a medium by the overhanging claws.

In a case where the normal claws 520 illustrated in FIG. 15 are used and an edge length on a side of the one end 510A of the medium 510 is 7.0 millimeters or less, the lifting of the one end 510A of the medium 510 in the width direction can be suppressed.

The edge length on the side of the one end 510A of the medium 510 is a distance from an outer end 520B of a normal claw 520A, which is at a position closest to the one end 510A of the medium 510, to the one end 510A of the medium 510 in the width direction. The same applies to an edge length on a side of the other end 510B of the medium 510.

The outer end 520B of the normal claw 520A is an end of the normal claw 520 which is on an opposite side to the transporting center CL in the axial direction of a transport drum. The same applies to the outer end 520D of a normal claw 520C.

As illustrated in FIG. 15, depending on a full length of the medium 510 in the width direction, the edge length on the side of the one end 510A of the medium 510 or the edge length on the side of the other end 510B of the medium 510 becomes 8.0 millimeters or more in some cases.

In addition, in a case where a distance between the adjacent normal claws 520 is 35 millimeters or more, or depending on transporting accuracy of a medium, the edge length on the side of the one end 510A of the medium 510 or the edge length on the side of the other end 510B of the medium 510 becomes 8.0 millimeters or more in some cases.

In addition, in a case where the normal claws 520 illustrated in FIG. 15 are used, a moving distance of the medium 510 in the width direction is expected to be relatively large. For example, the moving distance of the medium 510 in the width direction in a case where the normal claws 520 illustrated in FIG. 15 are used is 27.0 millimeters.

On the other hand, the moving distance of the medium 510 in the width direction in a case where the overhanging claws 500 illustrated in FIG. 16 are used is 18.0 millimeters. Then, in a case where the normal claws 520 illustrated in FIG. 15 are used, it becomes necessary to make a length of the first trailing end adsorbing region 420 illustrated in FIG. 8 in the medium width direction larger.

In a case where the length of the first trailing end adsorbing region 420 in the medium width direction is made larger, the number of adsorption holes that do not suck a medium relatively increases. For example, there is a possibility of a decrease in a transporting performance in a case where a thick medium is transported. The adsorption holes that do not suck a medium are adsorption holes that do not cover the medium.

On the contrary, in a case where the overhanging claws 500 illustrated in FIG. 16 are used, it is possible to make an edge length of the medium 510 on the side of the one end 510A in the width direction and an edge length of the medium 510 on the side of the other end 510B in the width direction relatively small.

In addition, in a case where the overhanging claws 500 are used, it is possible to make the moving distance of the medium 510 in the width direction relatively small.

Modification Example of Second Embodiment

Figure 17:
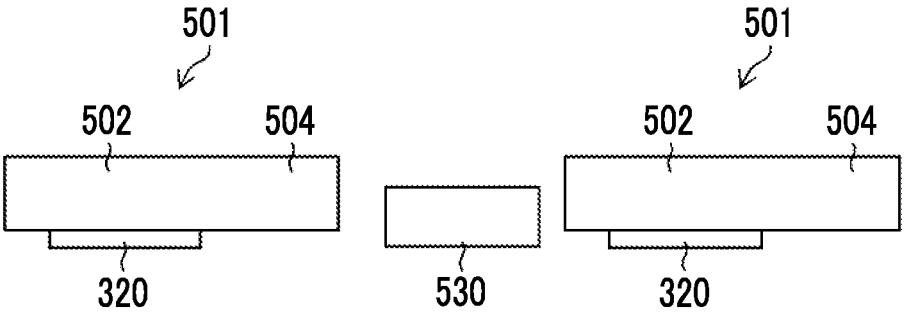
FIG. 17 is an explanatory view of a position of a claw stand in a case where the overhanging claw is used.

FIG. 17 is an explanatory view of a position of a claw stand in a case where overhanging claws are used. In each of overhanging claws 501 illustrated in FIG. 17, the overhanging region 504 is formed on only the other side of the gripping region 502 in the axial direction of a transport drum.

Figure 18:
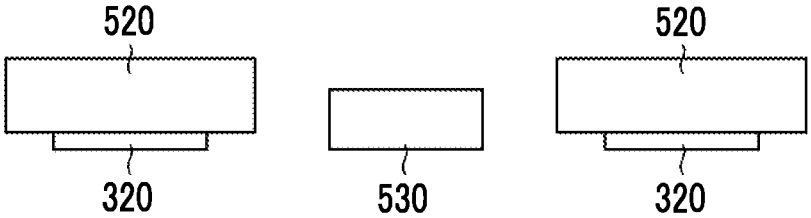
FIG. 18 is an explanatory view of a position of the claw stand in a case where the normal claw is used.

FIG. 18 is an explanatory view of a position of a claw stand in a case where the normal claws are used. Claw stands 530 illustrated FIGS. 17 and 18 are a claw stand of a first transporting member that delivers a medium to the transport drum 300 illustrated in FIG. 1, and is a claw stand of a second transporting member that receives the medium from the transport drum 300, respectively.

In a case where the normal claws 520 are used as illustrated in FIG. 18, each of the claw stands 530 of the first transporting member and the second transporting member is disposed at a center position between the two adjacent claw stands 320. As illustrated in FIG. 17, the position of the claw stand 530 of the first transporting member or the second transporting member is moved from the center position between the two adjacent claw stands 320.

Then, it is possible to make a full length of each of the overhanging regions 504 in the axial direction of a transport drum relatively large.

[Description of Control System]

Next, a control system of the medium transporting device comprising the transport drum 300 described with reference to FIGS. 1 to 18 will be described in detail. FIG. 19 is a block diagram of the control system.

A medium transporting device 301 comprises a system controller 600. The system controller 600 comprises a CPU 602, a ROM 604, and a RAM 606. The CPU is an abbreviation for a central processing unit. The ROM is an abbreviation for a read only memory. The RAM is an abbreviation for a random access memory.

The system controller 600 functions as an overall control unit that comprehensively controls each unit of the medium transporting device 301. In addition, the system controller 600 functions as an arithmetic unit that performs various types of arithmetic processing. The system controller 600 may execute a program and control each unit of the medium transporting device 301.

The system controller 600 may function as a memory controller that reads out data in a memory including the ROM 604 and the RAM 606, and controls data writing.

The medium transporting device 301 comprises a suction control unit 610. The suction control unit 610 controls operation of a suction unit 612 in accordance with a command sent out from the system controller 600. The suction unit 612 generates an adsorption pressure in the adsorption holes 278 of the transport drum 300 illustrated in FIG. 1. The adsorption holes 278 are illustrated in FIG. 4. A pump is applicable to the suction unit 612.

The medium transporting device 301 comprises a gripper control unit 614. The gripper control unit 614 controls operation of the grippers 319 illustrated in FIG. 1 or the gripper 319A illustrated in FIG. 12 in accordance with a command sent out from the system controller 600.

The medium transporting device 301 comprises a medium movement control unit 616. The medium movement control unit 616 controls operation of the medium position moving unit 450 illustrated in FIG. 11 in accordance with a command sent out from the system controller 600.

The medium transporting device 301 shown in FIG. 19 comprises a drive control unit 618. The drive control unit 618 controls operation of a drive unit 620 in accordance with a command sent out from the system controller 600. The drive unit 620 includes a motor which is a drive source in a case where the transport drum 300 illustrated in FIG. 1 is rotated.

The drive control unit 618 shown in FIG. 19 controls operation start timing, operation stop timing, and a rotation speed of the transport drum 300 illustrated in FIG. 1.

The medium transporting device 301 comprises a medium position sensor 626. The medium position sensor 626 detects a position of a medium which is being supplied to the transport drum 300 illustrated in FIG. 1. The medium position sensor 626 outputs a detection signal indicating information of the position of the medium. The detection signal output from the medium position sensor 626 is sent out to the system controller 600. The system controller 600 may operate the medium position moving unit 450 via the medium movement control unit 616 with the use of an output signal of the medium position sensor 626.

The medium transporting device 301 may comprise a storage unit in which the moving distance L shown in FIG. 7 is associated with a size of a medium and is stored. The medium movement control unit 616 shown in FIG. 19 may acquire the information of the size of the medium, and read out the moving distance L corresponding to the size of the medium from the storage unit (not illustrated).

The medium movement control unit 616 may control operation of the medium position moving unit 450 with the moving distance L corresponding to the size of the medium, which is read out from the storage unit (not illustrated), as a parameter.

Each unit is listed for each function in FIG. 19. It is possible to integrate, separate, combine, or omit each unit shown in FIG. 19 as appropriate.

[Application Example of Liquid Jetting Device]

Next, an application example of the liquid jetting device to which the medium transporting device described with reference to FIGS. 1 to 19 is applied will be described. In this example, an ink jet recording device will be given as an example of the liquid jetting device.

The transport drum 300 described with reference to FIGS. 1 to 18 is applicable to a drawing drum 52 illustrated in FIG. 20. It is possible to make a transporting control unit 110 shown in FIG. 21 a configuration element of the control system shown in FIG. 19.

<Overall Configuration>

Figure 20:
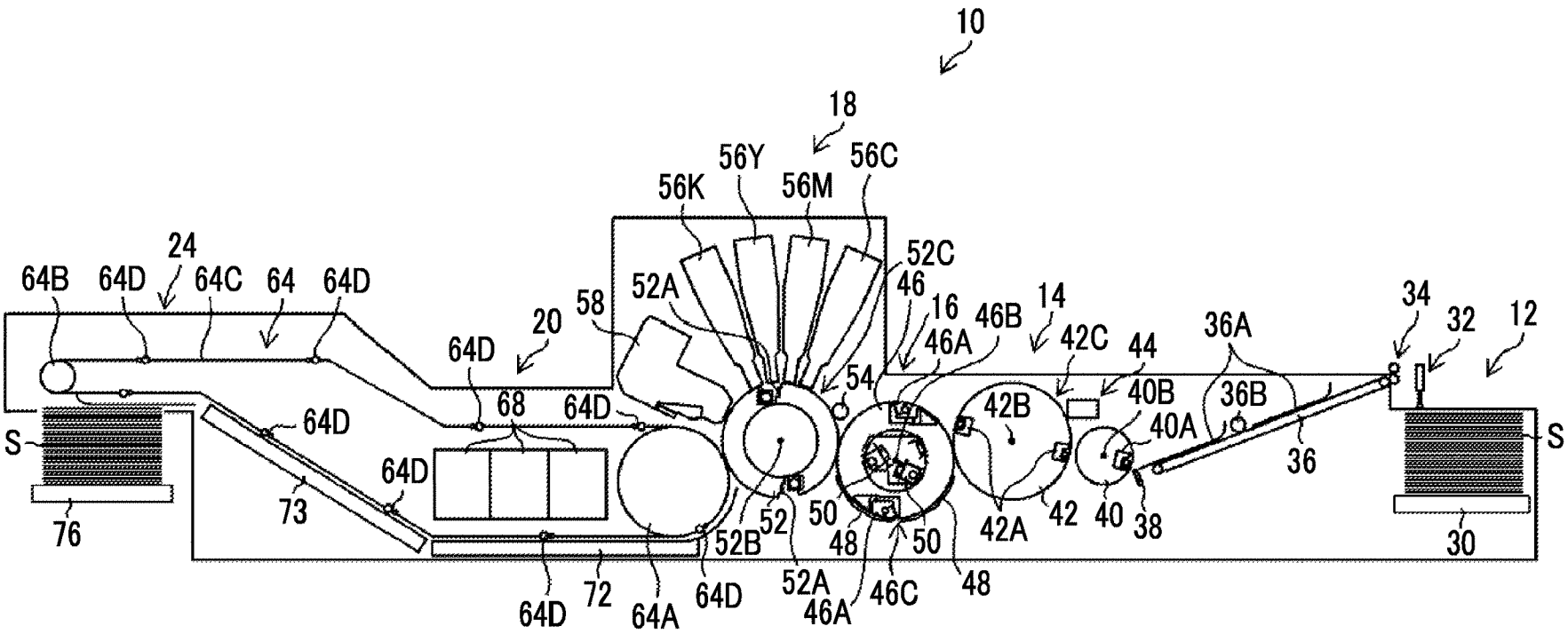
FIG. 20 is an overall configuration view of an ink jet recording device.

FIG. 20 is an overall configuration view of the ink jet recording device. The ink jet recording device is an aspect of the liquid jetting device. An ink is an aspect of a liquid. In the present specification, it is possible to interchangeably use the term "ink" and the term "liquid". In addition, the term "jetting" is synonymous with the term "dropping", "image forming", or "image recording".

An ink jet recording device 10 illustrated in FIG. 20 is an ink jet recording device that draws an image onto a sheet S, which is flat paper, with the use of an ink in an ink jet system. A sheet-like member including paper, a resin, and a metal can be given as an example of the sheet S. The sheet-like member including a resin and a metal may include a member called a base material or a substrate. The sheet S is an aspect of the medium.

The ink jet recording device 10 mainly comprises a sheet feeding unit 12, a treatment liquid applying unit 14, a treatment liquid dry-processing portion 16, a drawing unit 18, an ink dry-processing unit 20, and a sheet outputting unit 24. Hereinafter, each unit will be described in detail.

<Sheet Feeding Unit>

The sheet feeding unit 12 comprises a sheet feeding stand 30, a sucker device 32, a pair of sheet feeding rollers 34, the feeder board 36, a front pad 38, and a sheet feeding drum 40. The feeder board 36 comprises a retainer 36A and a guide roller 36B.

The retainer 36A and the guide roller 36B are disposed on a transporting surface of the feeder board 36 on which the sheet S is transported. The front pad 38 is disposed between the feeder board 36 and the sheet feeding drum 40.

The sheet feeding drum 40 has a cylindrical shape of which a longitudinal direction is a direction parallel to a rotary shaft 40B. The sheet feeding drum 40 has a length in the longitudinal direction, which exceeds a full length of the sheet S. A direction of the rotary shaft 40B of the sheet feeding drum 40 is direction that penetrates the page of FIG. 20.

The drum is a transporting member that has a cylindrical shape and transports a medium along an outer circumferential surface of the cylindrical shape by supporting at least a part of the medium and rotating about a center axis of the cylindrical shape.

The sheet feeding drum 40 comprises a gripper 40A. The gripper 40A comprises a plurality of claws, a claw stand, and a gripper shaft. Illustration of the plurality of claws, the claw stand, and the gripper shaft is omitted in FIG. 20.

The plurality of claws of the gripper 40A are arranged along the direction parallel to the rotary shaft 40B of the sheet feeding drum 40. Base end portions of the plurality of claws are swingably supported by the gripper shaft. An arrangement interval between the plurality of claws and a length of a region where the plurality of claws are arranged are determined according to a size of the sheet S.

The claw stand is a member of which a longitudinal direction is the direction parallel to the rotary shaft 40B of the sheet feeding drum 40. A length of the claw stand in the longitudinal direction of the sheet feeding drum 40 is a length of the region where the plurality of claws are arranged or more. The claw stand is disposed at a position of opposing the plurality of claws.

The sheet feeding unit 12 feeds the sheet S loaded on the sheet feeding stand 30 one by one to the treatment liquid applying unit 14. The sheet S loaded on the sheet feeding stand 30 is pulled up by the sucker device 32 in turn one by one from above, and is fed to the pair of sheet feeding rollers 34.

The sheet S fed to the pair of sheet feeding rollers 34 is placed on the feeder board 36, and is transported by the feeder board 36. The retainer 36A and the guide roller 36B press the sheet S transported by the feeder board 36 against the transporting surface of the feeder board 36, thereby correcting unevenness.

An inclination of the sheet S transported by the feeder board 36 is corrected by abutting a leading end thereof against the front pad 38. The sheet S transported by the feeder board 36 is delivered to the sheet feeding drum 40.

A leading end region of the sheet S delivered to the sheet feeding drum 40 is gripped by the gripper 40A of the sheet feeding drum 40. By rotating the sheet feeding drum 40, the sheet S is transported along an outer circumferential surface of the sheet feeding drum 40. The sheet S transported by the sheet feeding drum 40 is delivered to the treatment liquid applying unit 14.

<Treatment Liquid Applying Unit>

The treatment liquid applying unit 14 comprises a treatment liquid drum 42 and a treatment liquid applying device 44. The treatment liquid drum 42 comprises grippers 42A.

The same configuration as the gripper 40A of the sheet feeding drum 40 can be applied to the grippers 42A.

The treatment liquid drum 42 illustrated in FIG. 20 has a diameter that is twice a diameter of the sheet feeding drum 40. The grippers 42A are arranged at two places in the treatment liquid drum 42. The two positions where the grippers 42A are arranged are positions shifted away from each other by a half circumference on an outer circumferential surface 42C of the treatment liquid drum 42.

The treatment liquid drum 42 has a configuration where the sheet S is fixed to the outer circumferential surface 42C that supports the sheet S. A configuration where the outer circumferential surface 42C of the treatment liquid drum 42 comprises a plurality of adsorption holes and a negative pressure acts on the plurality of adsorption holes can be given as an example of the configuration where the sheet S is fixed to the outer circumferential surface 42C of the treatment liquid drum 42.

The same configuration as the sheet feeding drum 40, except for the description made above, can be applied to the treatment liquid drum 42. The reference sign 42B indicates a rotary shaft of the treatment liquid drum 42.

A roller application method can be applied to the treatment liquid applying device 44. The treatment liquid applying device 44, to which the roller application method is applied, can adopt a configuration of comprising a treatment liquid tank, a measuring roller, and an application roller.

By rotating the treatment liquid drum 42 in a state where the leading end of the sheet S is gripped by the grippers 42A, the sheet S is transported along the outer circumferential surface 42C of the treatment liquid drum 42. The treatment liquid applying device 44 applies a treatment liquid to the sheet S transported along the outer circumferential surface 42C of the treatment liquid drum 42. The sheet S to which the treatment liquid is applied is sent to the treatment liquid dry-processing portion 16.

<Treatment Liquid Dry-Processing Portion>

The treatment liquid dry-processing portion 16 comprises a treatment liquid dry-processing drum 46, a sheet transporting guide 48, and a treatment liquid dry-processing unit 50. The treatment liquid dry-processing drum 46 comprises grippers 46A. The same configuration as the gripper 40A of the sheet feeding drum 40 can be applied to the grippers 46A.

The treatment liquid dry-processing drum 46 illustrated in FIG. 20 has a diameter that is twice the diameter of the sheet feeding drum 40. The grippers 46A are arranged at two places in the treatment liquid dry-processing drum 46. The two positions where the grippers 46A are arranged are positions shifted away from each other by a half circumference on an outer circumferential surface 46C of the treatment liquid dry-processing drum 46.

The same configuration of the sheet feeding drum 40 can be applied to a configuration of the treatment liquid dry-processing drum 46, except for the description made above. The reference sign 46B indicates a rotary shaft of the treatment liquid dry-processing drum 46.

The sheet transporting guide 48 is disposed at a position of opposing the outer circumferential surface 46C of the treatment liquid dry-processing drum 46. The sheet transporting guide 48 is disposed on a lower side of the treatment liquid dry-processing drum 46.

The treatment liquid dry-processing unit 50 is disposed inside the treatment liquid dry-processing drum 46. The treatment liquid dry-processing unit 50 comprises an air blowing unit that blows wind toward an outside of the treatment liquid dry-processing drum 46 and a heating unit that heats the wind. For convenience of illustration, reference signs of the air blowing unit and the heating unit are omitted.

The leading end of the sheet S delivered from the treatment liquid applying unit 14 to the treatment liquid dry-processing portion 16 is gripped by the grippers 46A of the treatment liquid dry-processing drum 46.

A surface of the sheet S, which is on an opposite side to a surface to which the treatment liquid is applied, is supported by the sheet transporting guide 48. In a case of being supported by the sheet transporting guide 48, the surface of the sheet S to which the treatment liquid is applied comes into a state of facing the outer circumferential surface 46C of the treatment liquid dry-processing drum 46.

By rotating the treatment liquid dry-processing drum 46, the sheet S is transported along the outer circumferential surface 46C of the treatment liquid dry-processing drum 46.

Wind, which is heated from the treatment liquid dry-processing unit 50, blows to the sheet S transported by the treatment liquid dry-processing drum 46, which is the sheet S supported by the sheet transporting guide 48, and thereby dry-processing is executed.

By dry-processing being executed on the sheet S, a solvent component in the treatment liquid applied to the sheet S is removed, and a treatment liquid layer is formed on the surface of the sheet S, to which the treatment liquid is applied. The sheet S on which dry-processing is executed by the treatment liquid dry-processing portion 16 is delivered to the drawing unit 18.

<Drawing Unit>

The drawing unit 18 comprises the drawing drum 52, a sheet pressing roller 54, a liquid jetting head 56C, a liquid jetting head 56M, a liquid jetting head 56Y, a liquid jetting head 56K, and an inline sensor 58.

The transport drum 300 described with reference to FIGS. 1 to 18 is applied to the drawing drum 52. Herein, description of the drawing drum 52 is omitted.

The sheet pressing roller 54 has a cylindrical shape. A longitudinal direction of the sheet pressing roller 54 is a direction parallel to a rotary shaft 52B of the drawing drum 52. The sheet pressing roller 54 has a length in the longitudinal direction, which exceeds the full length of the sheet S.

The sheet pressing roller 54 is disposed a downstream side of a position where the sheet S is delivered, which is an upstream side of the liquid jetting head 56C, in a sheet S transporting direction of the drawing drum 52. In the following description, the sheet S transporting direction is described as a sheet transporting direction or the medium transporting direction.

The sheet S transporting direction, the sheet transporting direction, or the medium transporting direction is an aspect of a relative movement direction between the liquid jetting heads and the medium. A liquid jetting head movement direction in a case where the liquid jetting heads are moved with respect to a fixed medium can be given as another aspect of the relative movement direction.

The liquid jetting head 56C, the liquid jetting head 56M, the liquid jetting head 56Y, and the liquid jetting head 56K each comprise a nozzle unit that jets an ink with the use of the ink jet system. Illustration of the nozzle unit is omitted.

Herein, an alphabet letter assigned to each liquid jetting head indicates a color of an ink. C indicates cyan. M indicates magenta. Y indicates yellow. K indicates black.

The liquid jetting head 56C, the liquid jetting head 56M, the liquid jetting head 56Y, and the liquid jetting head 56K are arranged on an upper side of the drawing drum 52. The liquid jetting head 56C, the liquid jetting head 56M, the liquid jetting head 56Y, and the liquid jetting head 56K are arranged along the sheet transporting direction from an upstream side in the sheet transporting direction in order of the liquid jetting head 56C, the liquid jetting head 56M, the liquid jetting head 56Y, and the liquid jetting head 56K.

A full line-type liquid jetting head may be applied to each of the liquid jetting head 56C, the liquid jetting head 56M, the liquid jetting head 56Y, and the liquid jetting head 56K. The liquid jetting head 56C, the liquid jetting head 56M, the liquid jetting head 56Y, and the liquid jetting head 56K may each have a structure in which a plurality of nozzle units are arranged in a matrix.

A piezo jet method, in which liquids are jetted from the nozzle units with the use of bending deformation of piezoelectric elements, may be applied to the liquid jetting head 56C, the liquid jetting head 56M, the liquid jetting head 56Y, and the liquid jetting head 56K.

A structure in which a plurality of head modules are connected along a longitudinal direction may be applied to each of the liquid jetting head 56C, the liquid jetting head 56M, the liquid jetting head 56Y, and the liquid jetting head 56K.

The inline sensor 58 is disposed at a position on a downstream side of the liquid jetting head 56K in the sheet transporting direction. The inline sensor 58 comprises an imaging element, a peripheral circuit of the imaging element, and a light source.

It is possible to apply a solid-state imaging element including a CCD image sensor and a CMOS image sensor to the imaging element. Illustration of the imaging element, the peripheral circuit of the imaging element, and the light source is omitted. The CCD is an abbreviation for a charge coupled device. The CMOS is an abbreviation for a complementary metal-oxide semiconductor.

The peripheral circuit of the imaging element comprises a processing circuit for an output signal of the imaging element. A filter circuit that removes a noise component from the output signal of the imaging element, an amplifier circuit, or a waveform shaping circuit can be given as an example of the processing circuit. Illustration of the filter circuit, the amplifier circuit, or the waveform shaping circuit is omitted.

The light source is disposed at a position that allows a reading target of the inline sensor 58 to be irradiated with illumination light. An LED or a lamp can be applied to the light source. The LED is an abbreviation for a light emitting diode.

The leading end of the sheet S delivered from the treatment liquid dry-processing portion 16 to the drawing unit 18 is gripped by grippers 52A of the drawing drum 52. Due to the rotation of the drawing drum 52, the sheet S, of which the leading end is gripped by the grippers 52A of the drawing drum 52, is transported along an outer circumferential surface 52C of the drawing drum 52.

In a case of passing below the sheet pressing roller 54, the sheet S is pressed against the outer circumferential surface 52C of the drawing drum 52. Immediately below the liquid jetting head 56C, the liquid jetting head 56M, the liquid jetting head 56Y, and the liquid jetting head 56K, an image is formed onto the sheet S that has passed below the sheet pressing roller 54 with the use of a color ink jetted from each of the liquid jetting head 56C, the liquid jetting head 56M, the liquid jetting head 56Y, and the liquid jetting head 56K.

From the sheet S on which the image is formed by the liquid jetting head 56C, the liquid jetting head 56M, the liquid jetting head 56Y, and the liquid jetting head 56K, the inline sensor 58 reads out the image, which is in a reading region of the inline sensor 58.

The sheet S, on which the image is read out by the inline sensor 58, is delivered from the drawing unit 18 to the ink dry-processing unit 20. It is possible to determine the presence or absence of a jet abnormality from an image reading result obtained by the inline sensor 58.

<Ink Dry-Processing Unit>

The ink dry-processing unit 20 comprises a chain gripper 64, an ink dry-processing unit 68, and a guide plate 72. The chain gripper 64 comprises a first sprocket 64A, a second sprocket 64B, a chain 64C, and a plurality of grippers 64D.

The chain gripper 64 has a structure in which a pair of endless chains 64C is wound around a pair of first sprockets 64A and a pair of second sprockets 64B. Only one of each of the pair of first sprockets 64A, the pair of second sprockets 64B, and the pair of chains 64C is illustrated in FIG. 20.

The chain gripper 64 has a structure in which the plurality of grippers 64D are arranged between the pair of chains 64C. In addition, the chain gripper 64 has a structure in which the plurality of grippers 64D are arranged at a plurality of positions in the sheet transporting direction. Out of the plurality of grippers 64D arranged between the pair of chains 64C, only one gripper 64D is illustrated in FIG. 20.

The chain gripper 64 illustrated in FIG. 20 includes a horizontal transporting region where the sheet S is transported along a horizontal direction and an inclined transporting region where the sheet S is transported in a diagonally upward direction.

The ink dry-processing unit 68 is disposed at a position on an upper side of a transport path of the sheet S in the chain gripper 64. A configuration where a heat source, including a halogen heater and an infrared heater, is included can be given as a configuration example of the ink dry-processing unit 68. A configuration where a fan that blows air heated by the heat source to the sheet S is included as another configuration example of the ink dry-processing unit 68. The ink dry-processing unit 68 may be configured to include the heat source and the fan.

Although detailed illustration of the guide plate 72 is omitted, a plate-like member is applied to the guide plate 72. The guide plate 72 has a length in a direction orthogonal to the sheet transporting direction, which exceeds the full length of the sheet S.

The guide plate 72 is disposed along the transport path of the sheet S in the horizontal transporting region in which the chain gripper 64 is used. The guide plate 72 is disposed at a position on a lower side along the transport path of the sheet S, in which the chain gripper 64 is used. The guide plate 72 has a length in the sheet transporting direction, which corresponds to a length of a processing region of the ink dry-processing unit 68.

The length corresponding to the length of the processing region of the ink dry-processing unit 68 is the length of the guide plate 72 that allows the guide plate 72 to support the sheet S in a case of processing of the ink dry-processing unit 68.

For example, an aspect in which the length of the processing region of the ink dry-processing unit 68 and the length of the guide plate 72 in the sheet transporting direction are made the same can be given as an example. The guide plate 72 may have a function of adsorbing and supporting the sheet S.

The leading end of the sheet S delivered from the drawing unit 18 to the ink dry-processing unit 20 is gripped by the grippers 64D. By rotating at least one of the first sprockets 64A or the second sprockets 64B clockwise in FIG. 20 and thereby running the chains 64C, the sheet S is transported along a running path of the chains 64C.

In a case where the sheet S passes the processing region of the ink dry-processing unit 68, ink dry-processing is executed onto the sheet S by the ink dry-processing unit 68.

The sheet S, on which ink dry-processing is executed by the ink dry-processing unit 68, is transported by the chain gripper 64, and is sent to the sheet outputting unit 24.

At a position on a downstream side of the ink dry-processing unit 68 in the sheet transporting direction, the chain gripper 64 illustrated in FIG. 20 transports the sheet S diagonally upward and left in FIG. 20. A guide plate 73 is disposed in the transport path in the inclined transporting region where the sheet S is transported diagonally upward and left in FIG. 20.

The same member as the guide plate 72 can be applied to the guide plate 73. Herein, description of a structure and a function of the guide plate 73 is omitted.

<Sheet Outputting Unit>

The sheet outputting unit 24 comprises a sheet outputting stand 76. The chain gripper 64 is applied in transporting of the sheet S by the sheet outputting unit 24.

The sheet outputting stand 76 is disposed at a position on a lower side along the transport path of the sheet S in which the chain gripper 64 is used. It is possible for the sheet outputting stand 76 to have a configuration of including a raising and lowering mechanism (not illustrated). By raising and lowering the sheet outputting stand 76 according to an increase and a decrease in the number of the loaded sheets S, a height of the sheet S positioned on the uppermost can be kept fixed.

The sheet outputting unit 24 collects the sheet S on which the series of types of processing of image forming are executed. In a case where the sheet S reaches a position of the sheet outputting stand 76, the grippers 64D release the gripping of the sheet S. The sheet S is loaded onto the sheet outputting stand 76.

Although the ink jet recording device 10 comprising the treatment liquid applying unit 14 and the treatment liquid dry-processing portion 16 is illustrated in FIG. 20, an aspect in which the treatment liquid applying unit 14 and the treatment liquid dry-processing portion 16 are omitted is also possible.

<Description of Control System>

FIG. 21 is a block diagram of a control system of an ink jet recording device illustrated in FIG. 20. As shown in FIG. 21, the ink jet recording device 10 comprises a system controller 100. The system controller 100 comprises a CPU 105, a ROM 106, and a RAM 107.

The ROM 106 and the RAM 107 shown in FIG. 21 may be disposed outside the CPU. The CPU is an abbreviation for a central processing unit. The ROM is an abbreviation for a read only memory. The RAM is an abbreviation for a random access memory.

The system controller 100 functions as an overall control unit that comprehensively controls each unit of the ink jet recording device 10. In addition, the system controller 100 functions as an arithmetic unit that performs various types of arithmetic processing. The system controller 100 may execute a program and control each unit of the ink jet recording device 10.

The system controller 100 may function as a memory controller that reads out data in a memory including the ROM 106 and the RAM 107, and controls data writing.

The ink jet recording device 10 comprises a communication unit 102, an image memory 104, the transporting control unit 110, a sheet feeding control unit 112, a treatment liquid application control unit 114, a treatment liquid drying control unit 116, the drawing control unit 118, an ink drying control unit 120, and a sheet outputting control unit 124.

The communication unit 102 comprises a communication interface (not illustrated). The communication unit 102 transmits and receives data to and from a host computer 103 connected to the communication interface.

The image memory 104 functions as a temporary storage unit of various types of data including image data. The image memory 104 reads out and writes data through the system controller 100. The image data read from the host computer 103 via the communication unit 102 is temporarily stored in the image memory 104.

The transporting control unit 110 controls operation of a transporting unit 11 of the sheet S in the ink jet recording device 10. The treatment liquid drum 42, the treatment liquid dry-processing drum 46, the drawing drum 52, and the chain gripper 64, which are illustrated in FIG. 20, are included in the transporting unit 11 shown in FIG. 21.

It is possible for the transporting control unit 110 shown in FIG. 21 to include the control system of the medium transporting device 301 shown in FIG. 19 as a configuration element. It is possible for the system controller 100 shown in FIG. 21 to include the system controller 600 shown in FIG. 19 as a configuration element.

The sheet feeding control unit 112 shown in FIG. 21 controls operation of the sheet feeding unit 12 in accordance with a command from the system controller 100. The sheet feeding control unit 112 controls supply start operation of the sheet S and supply stop operation of the sheet S.

The treatment liquid application control unit 114 controls operation of the treatment liquid applying unit 14 in accordance with a command from the system controller 100. The treatment liquid application control unit 114 controls a treatment liquid application amount and application timing.

The treatment liquid drying control unit 116 operates the treatment liquid dry-processing portion 16 in accordance with a command from the system controller 100. The treatment liquid drying control unit 116 controls a drying temperature, flow rate of a drying gas, and drying gas spraying timing.

The drawing control unit 118 controls operation of the drawing unit 18 in accordance with a command from the system controller 100. The drawing control unit 118 controls ink jetting of the liquid jetting head 56C, the liquid jetting head 56M, the liquid jetting head 56Y, and the liquid jetting head 56K, which are illustrated in FIG. 20.

The drawing control unit 118 shown in FIG. 21 comprises an image processing unit (not illustrated). The image processing unit forms dot data from input image data. The image processing unit comprises a color separation processing unit, a color conversion processing unit, a correction processing unit, and a halftone processing unit (all of which are not illustrated).

The color separation processing unit executes color separation processing onto the input image data. For example, in a case where the input image data is expressed in RGB, the input image data is separated into data for each color of R, G, and B. Herein, R indicates red. G indicates green. B indicates blue.

The color conversion processing unit converts the image data for each color, which is separated into R, G, and B, into C, M, Y, and K corresponding to each ink color. Herein, C indicates cyan. M indicates magenta. Y indicates yellow. K indicates black.

The correction processing unit executes correction processing onto the image data for each color converted to C, M, Y, and K. Gamma-correction processing, density unevenness correction processing, or abnormal recording element correction processing can be given as an example of the correction processing.

The halftone processing unit converts, for example, image data expressed in a multi-gradation number of 0 to 255 to binary dot data or dot data expressed in multiple values such as three or more values but less than the gradation number of the input image data.

A halftone processing rule determined in advance is applied to halftone processing in which the halftone processing unit is used. Dithering or error diffusion can be given as an example of the halftone processing rule. The halftone processing rule may be changed according to an image recording condition or content of image data.

The drawing control unit 118 comprises a waveform generating unit, a waveform storage unit, and a drive circuit (all of which are not illustrated). The waveform generating unit generates a waveform of a drive voltage. The waveform storage unit stores the waveform of the drive voltage. The drive circuit generates a drive voltage having a drive waveform according to dot data. The drive circuit supplies the drive voltage to the liquid jetting head 56C, the liquid jetting head 56M, the liquid jetting head 56Y, and the liquid jetting head 56K, which are illustrated in FIG. 20.

That is, jet timing for each pixel position and an ink jet amount are determined based on the dot data generated via processing in which the image processing unit is used, and a drive voltage according to the jet timing for each pixel position and the ink jet amount and a control signal that determines jet timing for each pixel are generated based on the dot data.

The drive voltage and the control signal are supplied to the liquid jetting head 56C, the liquid jetting head 56M, the liquid jetting head 56Y, and the liquid jetting head 56K. Dots are recorded onto the sheet S with the use of inks jetted from the liquid jetting head 56C, the liquid jetting head 56M, the liquid jetting head 56Y, and the liquid jetting head 56K based on the drive voltage and the control signal.

The ink drying control unit 120 controls operation of the ink dry-processing unit 20 in accordance with a command from the system controller 100. The ink drying control unit 120 controls a drying gas temperature, flow rate of a drying gas, or drying gas spraying timing.

The sheet outputting control unit 124 controls operation of the sheet outputting unit 24 in accordance with a command from the system controller 100. In a case where the sheet outputting stand 76 illustrated in FIG. 20 includes the raising and lowering mechanism, the sheet outputting control unit 124 controls operation of the raising and lowering mechanism according to an increase and a decrease in the number of the sheets S.

The ink jet recording device 10 shown in FIG. 21 comprises an operation unit 130, a display unit 132, a parameter storage unit 134, and a program storing unit 136.

The operation unit 130 comprises an operation member including an operation button, a keyboard, and a touch panel. The operation unit 130 may include a plurality of types of operation members. Illustration of the operation member is omitted.

Information input via the operation unit 130 is sent to the system controller 100. The system controller 100 executes various types of processing according to the information sent out from the operation unit 130.

The display unit 132 comprises a display device, including a liquid crystal panel, and a display driver. Illustration of the display device and the display driver is omitted in FIG. 21. The display unit 132 causes the display device to display various types of setting information of the device or various types of information including abnormality information in accordance with a command from the system controller 100.

The parameter storage unit 134 stores various types of parameters used in the ink jet recording device 10. The various types of parameters stored in the parameter storage unit 134 are read out via the system controller 100, and are set in each unit of the device.

The program storing unit 136 stores programs used by each unit of the ink jet recording device 10. The various types of programs stored in the program storing unit 136 are read out via the system controller 100, and are executed by each unit of the device.

Each unit is listed for each function in FIG. 21. It is possible to integrate, separate, combine, or omit each unit shown in FIG. 21 as appropriate.

Hardware structures of various types of processing units shown in FIGS. 19 and 21 are various types of processors described below. The various types of processors include a CPU, a PLD, and an ASIC. Although the various types of processing units shown in FIGS. 19 and 21, which are examples of the processing unit, are substantially in charge of processing, the term "processing unit" is not used in names thereof in some cases. A case where the term "control unit" is used can also be included in the concept of the various types of processing unit.

The transporting control unit 110, the sheet feeding control unit 112, and the drawing control unit 118 can be given as examples of the various types of processing units shown in FIGS. 19 and 21. There are some control units that each have a name in which the term "processing unit" is used. There are some processors that each have a name in which the term "processor" is used.

The CPU is a general purpose processor that executes software and functions as various types of processing units. It is possible to interchangeably use software with a program. The PLD is a processor that can change a circuit configuration after manufacturing. An FPGA can be given as an example of the PLD. The PLD is an abbreviation for a programmable logic device. The FPGA is an abbreviation for a field programmable gate array.

The ASIC is a processor that has a dedicated circuit configuration designed in order to execute certain processing, or a dedicated electric circuit. The ASIC is an abbreviation for an application specific integrated circuit.

One processing unit may be configured of one of the various types of processors described above. One processing unit may be configured with the use of the same type of two or more processors, or different types of two or more processors. A plurality of FPGAs can be given as an example of the same type of two or more processors. A combination of a CPU and an FPGA can be given as an example of different types of two or more processors.

In addition, a plurality of processing units may be configured with the use of one processor. An aspect in which one processor is configured with the use of a combination of one or more CPUs and software, and the one processor functions as a plurality of processing units can be given as an example of configuring a plurality of processing units with the use of one processor. A computer including a server and a client can be given as a specific example.

An aspect in which a processor that realizes a function of a system including a plurality of processing units with one IC chip is used can be given as another example of configuring a plurality of processing units with one processor. A system on chip can be given as a specific example. The system on chip is written as an SoC in some cases. The IC is an abbreviation for an integrated circuit.

As described above, the various types of processing units shown in FIGS. 19 and 21 are configured with the use of one or more processors of the various types of processors described above as a hardware structure.

More specifically, the hardware structures of the various types of processors described above are electric circuits combined with a circuit element including a semiconductor element. The electric circuit is written as circuitry in some cases.

A memory, a storage element, or a storage device can be given as a specific example of the various types of storage units shown in FIGS. 19 and 21. A storage device that stores various types of programs can be given as an example of the program storing unit 136 shown in FIG. 21.

Although the transport drum is given as an example of a medium transporting unit comprised in the medium transporting device in the embodiment, the medium transporting device may comprise a medium transporting unit that transports a medium along any plane including a horizontal plane, instead of the transport drum.

Although the ink jet recording device is given as an example of the liquid jetting device in the present specification, the liquid jetting device is not limited to an ink jet recording device for graphic application. It is possible for the liquid jetting device to be widely applied to an ink jet pattern forming device for industrial application that performs electrical wiring formation and mask pattern formation as well.

It is possible to change, add, and eliminate a configuration requirement of the embodiments of the present invention, which are described hereinbefore, as appropriate without departing from the spirit of the present invention. Without being limited to the embodiments described above, it is possible for those skilled in the art to make many modifications to the present invention without departing from the technical scope of the present invention.

EXPLANATION OF REFERENCES

10: ink jet recording device
11: transporting unit
12: sheet feeding unit
14: treatment liquid applying unit
16: treatment liquid dry-processing portion
18: drawing unit
20: ink dry-processing unit
24: sheet outputting unit
30: sheet feeding stand
32: sucker device
34: pair of sheet feeding rollers
36: feeder board
36A: retainer
36B: guide roller
38: front pad
40: sheet feeding drum
40A, 42A, 46A, 52A, 64D, 319, 319A: gripper
40B, 42B, 46B, 52B, 302: rotary shaft
42: treatment liquid drum
42C, 46C, 52C: outer circumferential surface
44: treatment liquid applying device
46: treatment liquid dry-processing drum
48: sheet transporting guide
50: treatment liquid dry-processing unit
52: drawing drum
54: sheet pressing roller
56C, 56M, 56Y, 56K: liquid jetting head
58: inline sensor
64: chain gripper
64A: first sprocket
64B: second sprocket
64C: chain
68: ink dry-processing unit
72: guide plate
73: guide plate
76: sheet outputting stand
100, 600: system controller
102: communication unit
103: host computer
104: image memory
105, 602: CPU
106, 604: ROM
107, 606: RAM
110: transporting control unit
112: sheet feeding control unit
114: treatment liquid application control unit
116: treatment liquid drying control unit
118: drawing control unit
120: ink drying control unit
124: sheet outputting control unit
130: operation unit
132: display unit
134: parameter storage unit
136: program storing unit
252: first support region
254: second support region
256: third support region
258: leading end position
260A, 260B, 260C: trailing end adsorption groove
261A, 261B, 261C, 266, 274: throttle portion
262: non-end adsorption groove
268: first rib
270: second rib
271: third rib
272A: first leading end adsorption groove
272B: second leading end adsorption groove
278: adsorption hole
300: transport drum
301: medium transporting device
302: rotary shaft
304: medium supporting surface
306: medium adsorbing region
308A, 308B, 308C: non-opening portion
310: leading end region supporting unit
312: non-opening portion
314, 316: dummy half-etched portion
318: gripper base
318B: shaft bracket
318C: opening and closing shaft
318D: opening and closing arm
318E: cam follower
319, 319A: gripper
320, 530: claw stand
321, 321A, 321B, 321C: claw
322: recessed portion
330: adsorption sheet
330A: adsorption hole layer
330B: adsorption groove layer
332 drum adsorption groove
334: leading end drum adsorption groove

336: main body portion
338: drum adsorption hole
410, 416, 418, 510: medium
410A, 410B, 416A, 416B, 420A, 420B, 430A, 430B, 432A, 432B, 510A, 510B, 520B, 520D: end
412, 412A: center position
420, 430, 432: first trailing end adsorbing region
422: second trailing end adsorbing region
424: third trailing end adsorbing region
450: medium position moving unit
452: medium transporting guide
454: first positioning guide
456: second positioning guide
458: third positioning guide
460: motor
462: linear motion mechanism
500: overhanging claw
502: gripping region
504: overhanging region
520, 520A, 520C: normal claw
610: suction control unit
612: suction unit
614: gripper control unit
618: drive control unit
616: medium movement control unit
620: drive unit
626: medium position sensor
CL: transporting center
S: sheet

What is claimed is:

1. A medium transporting device comprising:

a gripping unit that comprises a plurality of gripping members which grip a leading end region of a medium in a medium transporting direction;

a medium supporting unit that comprises a first adsorption supporting unit which adsorbs and supports a trailing end region of the medium having a length determined in advance in the medium transporting direction from the trailing end of the medium in the medium transporting direction and a second adsorption supporting unit which adsorbs and supports a non-end region, which is a region other than the leading end region and the trailing end region of the medium, the second adsorption supporting unit generating an adsorption pressure less than an adsorption pressure generated by the first adsorption supporting unit;

a medium position moving unit that moves a position of the medium in a width direction, which is a direction orthogonal to the medium transporting direction, the medium being supplied to the medium supporting unit in the width direction; and a medium transporting unit that transports the medium supported by the medium supporting unit in the medium transporting direction, and the gripping unit and the medium supporting unit are disposed on the medium transporting unit, wherein regarding the width direction, the first adsorption supporting unit has a length, which is obtained by adding a length twice a moving distance of the medium by the medium position moving unit to a medium length of a size allowing the first adsorption supporting unit to adsorb and support the trailing end region, and a distance from a center position in the width direction to one end in the width direction is the same as a distance from the center position in the width direction to the other end in the width direction.

2. The medium transporting device according to claim 1, wherein regarding the width direction, the first adsorption supporting unit has a length, which is obtained by adding a length twice a moving distance of the medium by the medium position moving unit to a medium length of a maximum size allowing the first adsorption supporting unit to adsorb and support the trailing end region, and a distance from a center position in the width direction to one end in the width direction is the same as a distance from the center position in the width direction to the other end in the width direction.

3. The medium transporting device according to claim 1, wherein positions of both ends of the first adsorption supporting unit in the width direction are disposed at positions of any of the plurality of gripping members in the width direction.

4. The medium transporting device according to claim 1, wherein the medium position moving unit moves the medium, of which the one end of the medium in the width direction is not gripped, to a position where the gripping unit grips the one end of the medium in the width direction in a case where the center position of the medium in the width direction is aligned with a transporting center, which is a center position of the medium supporting unit in the width direction.

5. The medium transporting device according to claim 1, wherein the first adsorption supporting unit has a length corresponding to a plurality of types of media having different lengths in the width direction from each other.

6. The medium transporting device according to claim 1, wherein the medium supporting unit comprises a plurality of the first adsorption supporting units, and the plurality of the first adsorption supporting units are arranged along the medium transporting direction.

7. The medium transporting device according to claim 1, wherein the medium supporting unit comprises a third adsorption supporting unit that adsorbs and supports the trailing end region, regarding the width direction, the third adsorption supporting unit having a length, which is equal to or smaller than a medium length of a size allowing the third adsorption supporting unit to adsorb and support the trailing end region.

8. The medium transporting device according to claim 7, wherein the third adsorption supporting unit has a length which is equal to or smaller than a medium length of a maximum size allowing the third adsorption supporting unit to adsorb and support the trailing end region.

9. The medium transporting device according to claim 1, wherein the first adsorption supporting unit comprises a plurality of first adsorption holes, the second adsorption supporting unit comprises a plurality of second adsorption holes, and a total area of the plurality of first adsorption holes per unit area in the first adsorption supporting unit exceeds a total area of the plurality of second adsorption holes per unit area in the second adsorption supporting unit.

10. The medium transporting device according to claim 1, wherein the gripping member comprises a gripping claw and a claw stand, and has a structure of gripping the leading end region of the medium between the gripping claw and the claw stand, and at least one of the gripping claws respectively included in the plurality of gripping members is a wide claw having a length in the width direction, which is larger than the other gripping claws.

11. The medium transporting device according to claim 10, wherein in the wide claw, a gripping region, which grips the medium between the claw stand and the wide claw, has a projecting shape with respect to a non-gripping region, which does not grip the medium between the claw stand and the wide claw.

12. The medium transporting device according to claim 1, wherein the medium supporting unit is a transport drum that has a cylindrical shape, and rotates about a center axis of the cylindrical shape as a rotation axis to transport the medium along an outer circumferential surface.

13. The medium transporting device according to claim 12, wherein the transport drum comprises a main body portion and an adsorption sheet, and the first adsorption supporting unit and the second adsorption supporting unit are formed in the adsorption sheet, and the adsorption sheet is fixed by being wrapped around the main body portion.

14. A liquid jetting device comprising:

a liquid jetting head that comprises a plurality of jetting elements; and a medium transporting device that transports a medium to which a liquid is jetted from the liquid jetting head, wherein the medium transporting device comprises a gripping unit that comprises a plurality of gripping members which grip a leading end region of a medium in a medium transporting direction, a medium supporting unit that comprises a first adsorption supporting unit which adsorbs and supports a trailing end region of the medium having a length determined in advance in the medium transporting direction from the trailing end of the medium in the medium transporting direction and a second adsorption supporting unit which adsorbs and supports a non-end region, which is a region other than the leading end region and the trailing end region of the medium, the second adsorption supporting unit generating an adsorption pressure less than an adsorption pressure generated by the first adsorption supporting unit, a medium position moving unit that moves a position of the medium in a width direction, which is a direction orthogonal to the medium transporting direction, the medium being supplied to the medium supporting unit, in the width direction, and a medium transporting unit that transports the medium supported by the medium supporting unit in the medium transporting direction, and the gripping unit and the medium supporting unit are disposed on the medium transporting unit, and regarding the width direction, the first adsorption supporting unit has a length, which is obtained by adding a length twice a moving distance of the medium by the medium position moving unit to a medium length of a size allowing the first adsorption supporting unit to adsorb and support the trailing end region, and a distance from a center position in the width direction to one end in the width direction is the same as a distance from the center position in the width direction to the other end in the width direction.

15. The liquid jetting device according to claim 14, wherein the first adsorption supporting unit has a length in the width direction, which is obtained by adding a length twice a moving distance of the medium by the medium position moving unit to a medium length of a maximum size allowing the first adsorption supporting unit to adsorb and support the trailing end region, and a distance from a center position in the width direction to one end in the width direction is the same as a distance from the center position in the width direction to the other end in the width direction.

16. The liquid jetting device according to claim 14, further comprising:

a jetting control unit that controls jetting of the liquid jetting head, the jetting control unit changing the jetting elements that jet the liquid in response to movement of the medium in the width direction by the medium position moving unit.

* * * * *